US006391110B1

(12) United States Patent
Satou et al.

(10) Patent No.: US 6,391,110 B1
(45) Date of Patent: May 21, 2002

(54) METHOD AND APPARATUS FOR CLEANING TREATMENT

(75) Inventors: Fumio Satou; Mitsuhiro Sakai; Takeshi Tsukamoto, all of Kikuchi-gun; Yoichi Honda; Kiyomitsu Yamaguchi, both of Kumamoto; Tetsuya Sada, Kikuchi-gun; Kiyohisa Tateyama, Kumamoto, all of (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/686,820

(22) Filed: Oct. 12, 2000

Related U.S. Application Data

(62) Division of application No. 08/935,917, filed on Sep. 23, 1997, now Pat. No. 6,159,288.

(30) Foreign Application Priority Data

Sep. 24, 1996 (JP) ..... 8-271292
Jan. 22, 1997 (JP) ..... 9-009432

(51) Int. Cl.[7] ..... B05C 11/00; B08B 3/02

(52) U.S. Cl. ..... 118/52; 118/70; 134/60; 134/61; 134/109; 134/153; 134/902

(58) Field of Search ..... 134/902, 60, 61, 134/66, 109, 153; 118/52, 70

(56) References Cited

U.S. PATENT DOCUMENTS 4,788,994 A * 12/1988 Shinbara ..... 134/157
4,838,979 A * 6/1989 Nishida et al. ..... 156/345
4,871,417 A * 10/1989 Nishizawa et al. ..... 156/640
4,894,260 A * 1/1990 Kumasaka et al. ..... 427/241
4,903,717 A * 2/1990 Sumnitsch ..... 134/99
5,041,165 A 8/1991 Urbani
5,095,927 A * 3/1992 Thompson et al. ..... 134/902 X
5,235,995 A * 8/1993 Bergman et al. ..... 134/105
5,312,487 A * 5/1994 Akimoto et al. ..... 118/70 X
5,431,178 A * 7/1995 Chiu ..... 134/57 R
5,488,964 A * 2/1996 Murakami et al. ..... 134/95.3
5,518,542 A * 5/1996 Matsukawa et al. ..... 118/52
5,538,024 A 7/1996 Inada et al.
5,540,244 A * 7/1996 Brooks ..... 134/56 R
5,568,821 A * 10/1996 Ohmori et al. ..... 134/902 X
5,591,262 A * 1/1997 Sago et al. ..... 118/52
5,608,943 A * 3/1997 Konishi et al. ..... 15/302
5,677,000 A * 10/1997 Yoshioka et al. ..... 427/420
5,688,322 A * 11/1997 Motoda et al. ..... 118/52
5,730,162 A * 3/1998 Shindo et al. ..... 134/66
5,762,708 A * 6/1998 Motoda et al. ..... 118/52
5,776,250 A * 7/1998 Shin et al. ..... 118/52 X
5,778,911 A * 7/1998 Yoshio ..... 134/104.2
5,779,796 A * 7/1998 Tomoeda et al. ..... 118/319

FOREIGN PATENT DOCUMENTS

JP 216633 * 8/1990
JP 5-3184 * 1/1993 ..... 134/902

* cited by examiner

*Primary Examiner*—Philip Coe
(74) *Attorney, Agent, or Firm*—Oblon, Spivak, McClelland, Maier & Neustadt, P.C.

(57) ABSTRACT

An apparatus for a treatment is provided, the apparatus comprising a vessel for recovering a treatment liquid flowing out or flying out when the object is treated, cleaning means for cleaning an inner wall surface of the vessel by supplying a cleaning liquid into the vessel, and a circulation system for recovering a discharged liquid discharged from the vessel when the inner wall surface of the vessel is cleaned by the cleaning means and supplying the recovered liquid to the cleaning means.

4 Claims, 16 Drawing Sheets

METHOD AND APPARATUS FOR CLEANING TREATMENT

This application is a divisional of application Ser. No. 08/935,917, filed Sep. 23, 1997, and now U.S. Pat. No. 6,159,288.

BACKGROUND OF THE INVENTION

The present invention relates to a method and apparatus for a cleaning treatment in a system, in which, for example, substrates used for a liquid crystal display (hereafter referred to as LCD) and a semiconductor device are treated.

Recently, it has become an urgent need in apparatuses for various kinds treatment, for example in a resist coater which is used to form a resist film on a LCD substrate, that the size of an apparatus itself is reduced, the production cost is decreased and in addition a running cost of the apparatus is decreased.

In a resist coater generally used in a fabrication process of LCD, treatments of resist coating and cleaning are given on a glass substrate (an object to be treated), and there are two kinds of resist coater, which are of types of spin-coating and spray-coating.

A resist coater of a spin-coating type comprises, for example: a spin chuck, on which a glass substrate is mounted, and which is free to be shiftable vertically while being free to be rotatable; a resist solution instillator which supplies a resist liquid in the middle potion of the substrate drop by drop; a jet nozzle of a cleaning liquid to clean the surface of the substrate; and a rotary cup and a drainage cup being disposed outside the substrate in a manner doubly surrounding the substrate, wherein the rotary cup is inside the stationary cup and the rotary cup receives the resist liquid or a thinner flowing out or flying out from the substrate.

In such a resist coater, a glass substrate is mounted on a spin chuck which is free to be shiftable vertically while being free to be rotatable and a resist liquid is supplied to the middle portion of the substrate drop by drop while rotating the substrate to form a uniform resist film by a centrifugal force. In the case, a residue of the resist liquid which flows out or flies out from the substrate is received by the rotary cup to be discharged. In a following step, a height of the spin chuck is changed and a cleaning liquid is supplied from the cleaning liquid jet nozzle to the edge of the substrate to clean the edge portion of both surfaces of the substrate and a waste liquid is received by the drainage cup to be discharged. As a cleaning liquid, a solvent such as a thinner is used, since it is less in pollution and higher in safety.

In the same resist coater, since a used cleaning liquid (a waste liquid) has a lot of a resist ingredient dissolved therein, the used cleaning liquid cannot be reused on the substrate and is stored in a waste liquid storage unit through a waste liquid pipe. The waste liquid stored in the storage unit is wasted when it is accumulated to some extent.

In the drainage cup, since a thinner constantly including a resist ingredient is fed, the resist ingredient is piled up as a deposit on the inner wall of the cup in a adhered manner. When the resist ingredient is adhered and piled up to some extent, clogging will be caused, the inner wall of the drainage cup has been conventionally cleaned at an interval and the deposit has been separated off. Such a situation is also applied to the case of the rotary cup which directly receive the used resist liquid itself.

However, in a conventional resist coater, a thinner is sprayed toward the inner surface of a cup from a nozzle exclusively used for cleaning the inside of the cup disposed in the cup in order to remove the deposit inside the cup and therefore a lot of the thinner is required.

As described above, there has been a problem in a conventional resist coater, which is an apparatus for a coating treatment, that contamination such as an resist is adhered on the inner wall of a cup when the treatment is repeated and such contamination requires a lot of the thinner to be removed, so that the expense for cleaning is accumulated.

Besides, a used cleaning liquid cannot be used in a cleaning treatment of a glass substrate to be cleaned and therefore the used cleaning liquid is wasted as a waste liquid, which has been another cause to increase a running cost.

While application of a resist liquid on the surface of an object to be treated such as a LCD substrate has been effected by a spin coating method, In the case, since a LCD substrate has a rectangular shape, which causes a turbulent flow in the air by rotation, there arises a problem that uniformity of a thickness of a resist film cannot be maintained.

For such a reason, conventionally a surrounding space above, under and near the sides of a spin chuck as a holding means for holding LCD substrate and a LCD substrate are enclosed by a rotary cup with a cover and a rectifying plate is disposed above the LCD substrate in the rotary cup with a cover and the air supplied through an air supply port formed in the cover of the rotary cup with a cover is rectified by the rectifying plate to be discharged through an exhaust port located at the bottom of the rotary cup. In such a manner, A disorder in thickness of a resist film by a turbulence in the air have been avoided. A stationary cup is so disposed as to enclose the side and lower portions of the covered cup in order to prevent an air stream created by rotation of the rotary cup from flowing back into the inside of the rotary cup.

However, in a resist coater in which a resist liquid is applied by a spin coating method of this kind, a resist solution is sprayed outwardly by an centrifugal force and therefore a resist is adhered on the inner side and the bottom of the rotary cup, back surface of the covered cup, and the lower surface of the rectifying plate and the like. Besides, there is a fear that the resist is adhered in the inner side and the bottom of the stationary cup. In such a manner, a resist adhered on the rotary cup, the inside of the stationary cup, on the cover, the rectifying plate and the like is dried to produce particles. If the particles are adhered on a LCD substrate, a difficulty occurs on a circuit patterning and the like and at the same time a problem of reduction in a yield is resulted.

BRIEF SUMMARY OF THE INVENTION

It is an object of the present invention to provide a method and apparatus for a cleaning treatment, in which a cleaning liquid to be used for cleaning a treated object is effectively used.

It is a second object of the present invention to provide an apparatus for a treatment in which a cleaning solution is reused.

It is a third object of the present invention to provide an apparatus for a treatment in which a cleaning efficiency of a vessel can be achieved.

It is a fourth object of the present invention to provide an apparatus for a treatment in which a running cost of the whole apparatus can be reduced.

The fourth object of the present invention is to provide a method and apparatus for a cleaning treatment in which a coating liquid, such as a resist, adhered on a rotary cup and a stationary cup of a coating mechanism is removed to improve a yield.

In order to achieve the above mentioned objects, a method for a cleaning treatment of the present invention has a feature that the method comprises the steps of: cleaning a treated object is cleaned with a cleaning liquid supplied; then recovering the cleaning liquid; removing gas in the recovered cleaning liquid by separation; then storing the recovered liquid in a storing section; and reusing the stored cleaning liquid for cleaning an object to be treated.

In the method for a cleaning treatment, it is preferred that the stored cleaning liquid is used for cleaning the apparatus for a treatment for the object. Besides, it is also possible in a method for a cleaning treatment of the present invention that a cleaning liquid is additionally supplied to replenish the storing section for the recovered cleaning liquid with a cleaning liquid and a mixture of the added cleaning liquid and the recovered cleaning liquid is used for cleaning.

An apparatus for a cleaning treatment of the present invention comprises: first supply means for supplying a cleaning liquid to an object treated; a recovering pipe for recovering a cleaning liquid already used for cleaning of the object treated; gas/liquid separation means for separating gas from the recovered liquid by separation; a cleaning liquid storing section for storing the cleaning liquid separated by the gas/liquid separation means; and second cleaning liquid supply means for supplying the cleaning liquid in the cleaning storing section to an object o be cleaned.

In the apparatus for a cleaning treatment, it is preferred that the apparatus for a cleaning treatment further comprises second cleaning liquid supply means. In the same apparatus for a cleaning treatment of the present invention, the first cleaning liquid supply means has a plurality of nozzle holes for jetting a cleaning liquid toward positions, which do not interfere with each other, on both surfaces of peripheral portion of the treated object, and the recovering pipe is provided at a position outwardly and laterally of the nozzles. In the case, an opening of a route for a waste liquid which are connected to the recovering pipe at the other end preferably has a taper having the maximum diameter at the outermost end in order to effectively receive the cleaning liquid jetted from the nozzle holes. That is, it is preferred that the nozzle holes are located in the inside of the opening at the outermost end of the waste liquid route wherein the end portion has a taper and the diameter of the opening is the maximum in the tapered end portion. Moreover, the above mentioned cleaning liquid storing section can be preferably formed in such a manner that a cleaning liquid is directly supplemented from a cleaning liquid supply source.

According to the present invention, a cleaning liquid is supplied to an object to clean it, thereafter, the cleaning liquid is recovered, gas is separated and removed from the recovered liquid, then the recovered liquid is stored, the stored cleaning liquid is reused for cleaning of an object to be cleaned and thus the cleaning liquid can be effectively used. Accordingly, since a usage amount of the cleaning can be reduced, the cost is reduced and natural resources can be effectively used.

An efficiency of usage of a cleaning liquid in the same treatment system can be further increased by reusing a stored cleaning liquid for cleaning of an apparatus for a cleaning treatment, whereby a scale of the apparatus can be smaller, since the piping system of the cleaning liquid is simpler.

A cleaning efficiency is further increased by supplementing the storing section of the recovered cleaning liquid with the fresh cleaning liquid and using a liquid mixture of the supplementing cleaning liquid and recovered cleaning liquid for cleaning the object to be cleaned and a reliability of the apparatus for a cleaning apparatus can be improved. With the first cleaning supply means having nozzle holes to jet the cleaning liquid toward positions on both surface of a peripheral portion of the object treated at which streams of the cleaning liquid do not interfere with each other and with the recovering pipe provided at a position outwardly and laterally of the nozzle holes, since a cleaning liquid which is used in a first cleaning step and which is supplied from the first cleaning liquid supply means is recovered with a good efficiency, loss of the cleaning liquid is avoided and as a result a cleaning efficiency can be increased.

A second apparatus for a treatment of the present invention is directed to an apparatus comprising: a vessel for recovering a treatment liquid flowing out or flying out when an object is treated; cleaning means for cleaning the inner wall surface of the vessel by supplying a cleaning liquid into the vessel; and a circulating system for recovering a discharged liquid discharged from the vessel when the inner wall surface of the vessel is cleaned by the cleaning means and supplying it to the cleaning means.

In the second apparatus of the present invention, since the discharged liquid from the vessel when the inner wall surface of the vessel is cleaned by means of the cleaning means is recovered by the circulating system and supplied to the cleaning means which is used for cleaning the inside of the vessel, the cleaning liquid can be reused. Thereby, a usage volume of the cleaning liquid is reduced and at the same time the running cost of the whole apparatus can be reduced.

A third apparatus for a treatment of the present invention is directed to an apparatus defined as the second apparatus, wherein the circulating system comprises: a fresh cleaning liquid storing section for an unused cleaning liquid; a discharged liquid storing section for storing a discharged liquid discharged from the vessel; a cleaning liquid supply means for supplying the discharged liquid stored in the discharged liquid storing section and the unused cleaning liquid stored in the fresh cleaning liquid storing section, singly or in mixture, to the cleaning means.

In the third apparatus, since the discharged liquid stored in the discharged liquid storing section and the unused cleaning liquid stored in the fresh cleaning liquid storing section, singly or in mixture, are supplied to the cleaning means, no difficulty arises in cleaning a cup.

A fourth apparatus for a cleaning treatment of the present invention is directed to an apparatus defined as the second apparatus, wherein the circulating system comprises: a first discharged liquid storing section for storing a first discharged liquid collected and discharged to the vessel when at least part of the object already treated is cleaned; a second discharged liquid storing section for storing a second discharged liquid collected and discharged to the vessel when the inner wall surface of the vessel is cleaned; and a cleaning liquid supply means for supplying the first discharged liquid stored in the second discharged liquid storing section and the second discharged liquid stored in the second discharged liquid storing section, singly or in mixture, to the cleaning means.

In the fourth apparatus, since the first discharged liquid stored in the second discharged liquid storing section and the second discharged liquid stored in the second discharged liquid storing section, singly or in mixture, are supplied to the cleaning means, the once used cleaning liquid can be used with a good efficiency.

A fifth apparatus for a cleaning treatment of the present invention is directed to an apparatus defined as the fourth apparatus, wherein the cleaning liquid supply means supplies, for supplement, an unused cleaning liquid for cleaning at least part of the object already treated to at least one of the first discharge liquid storing section and the second discharge liquid storing section and supplies the stored liquids stored in the respective storing sections, single or in mixture, to the cleaning means.

In the fifth apparatus, since at least one of the first and second discharged liquid sections are supplemented with the unused cleaning liquid, that is a fresh cleaning liquid, to dilute the discharged liquids stored in the respective sections, and the discharged liquids, singly or in mixture, are supplied to the cleaning means, the once used cleaning liquid can be used without degrading a cleaning performance of the used cleaning liquid by any margin and the reuse of a cleaning liquid can be effected with a good efficiency.

A sixth apparatus of the present invention is directed to an apparatus defined as the second apparatus, wherein the circulating system comprises: a fresh liquid string section for storing an unused cleaning liquid; a first discharged liquid storing section for storing a first discharged liquid collected and discharged to the vessel when at least part of the object already treated is cleaned; a second discharged liquid storing section for storing a second discharged liquid collected and discharged to the vessel when the inner wall surface of the vessel is cleaned; and a cleaning liquid supply means for supplying the unused cleaning liquid stored in the fresh cleaning liquid storing section to at least one of the first discharged liquid storing section and the second discharged storing section and supplying to the cleaning means.

In the sixth apparatus, since the unused cleaning liquid stored in the fresh cleaning liquid storing section is added as supplement to at least one of the first and second discharged liquid sections and a discharged liquid from the at least one discharged liquid storing section supplemented with the unused cleaning liquid is supplied to the cleaning means, reuse of the cleaning liquid for cleaning a cup can be effected without any difficulty and without any degradation in a cleaning performance, so that a cleaning efficiency in cap cleaning is improved and a reliability of a cap cleaning operation is also increased.

A seventh apparatus of the present invention is directed to an apparatus defined as the second apparatus, wherein the circulating system comprises: a fresh cleaning liquid storing section for storing an unused cleaning liquid; a first discharged liquid storing section for storing a first discharged liquid collected and discharged to the vessel when at least part of the object already treated is cleaned; a second discharged liquid storing section for storing a second discharged liquid collected and discharged to the vessel when the inner wall surface of the vessel is cleaned; and a cleaning liquid supply means for supply the first discharged liquid stored in the first discharged liquid storing section, the second discharged liquid stored in the second discharged liquid storing section and the unused cleaning liquid stored in the fresh cleaning liquid storing section, singly of in mixture, to the cleaning means.

In the seventh apparatus, since the first discharged liquid stored in the first discharged liquid storing section, the second discharged liquid stored in the second discharged liquid storing section and the unused cleaning liquid stored in the fresh cleaning liquid storing section, singly of in mixture, are supplied to the cleaning means, the inside of the vessel can be cleaned with a good efficiency.

An eight apparatus of the present invention is directed to an apparatus defined as the third to seventh apparatus for a cleaning treatment, wherein the cleaning liquid supply means comprises: detecting means for detecting an amount of the cleaning liquid and discharged liquid stored in the respective storing sections; control means for controlling intake amounts of the cleaning liquid and discharged liquid based on the respective amounts detected by means of the detecting means.

In the eight apparatus, since the amounts of the cleaning liquid and discharged liquid stored in the respective storing sections are detected and the control means controls amounts of the cleaning liquid and discharged liquid which are fetched from the respective storing sections based on the amounts of the liquids detected by means of the detecting means, the amounts of the respective liquids being supplied to sections of the apparatus can be optimized.

A ninth apparatus of the present invention is directed to an apparatus defined as the third apparatus for a cleaning treatment, wherein the cleaning means comprises a first jetting unit for jetting the cleaning liquid toward the inner wall surface of the vessel in the vicinity of the object treated and a second jetting unit for jetting the cleaning liquid toward the inner wall surface in the vicinity of the discharge port remote from the object treated, and the circulating system supplies the discharged liquid, which is a used cleaning liquid, for the second jetting unit and the unused cleaning liquid for the first jetting unit.

In the ninth apparatus, since the discharged liquid, which is a used cleaning liquid, and the unused cleaning liquid are respectively to the second jetting unit and to the first jetting unit, the cleaning liquid can be used in the respective uses with a good efficiency.

A tenth apparatus of the present invention is directed to any of apparatuses defined as the first to ninth apparatuses, wherein the apparatus comprise a vessel for recovering a treatment liquid flowing out or flying out when the object is treated and the inner wall surface of the vessel has an ethylene fluoride based resin layer formed on the surface.

In the apparatuses, since the ethylene fluoride based resin layer is formed on the inner wall surface, the treatment liquid which flows out or flies out when the object is treated is less adhered.

An eleventh apparatus of the present invention is directed to any of apparatuses defined as the tenth apparatus, wherein the apparatus has an ethylene fluoride based resin layer formed on an inner surface of a recovering path inside the vessel in which the treatment liquid is recoverable.

In the eleventh apparatus, while part which is covered with an ethylene fluoride layer is limited, adhesion of the treatment liquid is minimized, so that, with a minimized usage amount of ethylene fluoride based resin, an effect that the reduced adhesion of the treatment liquid is achieved.

An aspect of the present invention is directed to an apparatus for a cleaning treatment of a cup in a coating mechanism, comprising: a rotary cup with a cover which is rotatable, and which encloses a holding means for holding an object treated and the side and bottom portions of the object to be treated; a stationary cup which encloses the side and bottom portions of the covered rotary cup; and a rectifying plate covering the object treated at a position thereabove, which is mounted inside the covered rotary cup, the apparatus comprising: a first nozzle for supplying a cleaning liquid on the rectifying plate by way of a supply hole bored in the middle of the cover of the covered rotary cup; a second nozzle, which is located under the holding means, for supplying the cleaning liquid toward the lower surface of the peripheral portion of the rectifying plate, the inner side surface of the covered rotary cup and the bottom surface of the stationary cup.

In the apparatus of the present invention, it is preferred that the apparatus further comprises a third nozzle, which is located inside the stationary cup, for supplying the cleaning liquid toward a lower part of the outside surface of the covered rotary cup and the inner side surface of the stationary cup. In this case, a lower part of the stationary cup is so formed that the inner surface is bent outwardly and the bottom is open and the cleaning liquid is supplied toward to the bent portion of the inner side surface of the stationary cup from the third nozzle.

An aspect of the present invention is directed to a method for a cleaning treatment of a cup in a coating mechanism comprising a rotary cup with a cover which is rotatable, and which encloses a holding means for holding an object treated and the side and bottom portions of the object treated; a stationary cup which encloses the side and bottom portions of the covered rotary cup; and a rectifying plate covering the object treated at a position thereabove, comprising the steps of: supplying a cleaning liquid through the middle of the cover of the covered rotary cup toward the rectifying plate while rotating the covered rotary cup to supply the cleaning liquid to the lower surface of the cover with the help of an centrifugal force; and at the same time supplying the cleaning liquid toward the lower surface of the outer periphery of the rectifying plate, the inner side surface of the covered rotary cup and the bottom surface of the stationary cup.

In the method of the present invention, it is preferred that the cleaning liquid is supplied on a lower part of the outside surface of the covered rotary cup and the inner side surface of the stationary cup.

In the method of the present invention, it is also preferred that the cleaning-liquid is supplied toward the rectifying plate from the middle of the cover of the covered rotary cup, while rotating the covered rotary cup at a first rotational speed; the cleaning liquid is supplied toward the lower surface of the outer peripheral portion of the rectifying plate and the inner side surface of the covered rotary cup, while rotating the covered rotary cup at a second rotational speed larger than the first rotational speed; and the cleaning liquid is supplied on the bottom surface of the covered rotary cup, while rotating the covered rotary cup at a third rotational speed smaller than the first rotational speed, wherein the speeds may be set in such a manner that, for example, the first rotational speed is in the range of from 350 to 650 rpm, the second rotational speed is in the range of from 700 to 1300 rpm and the third rotational speed is in the range of from 14 to 26 rpm.

According to the present invention, in a condition that the covered rotary cup is continued to rotates, the cleaning liquid is supplied toward the rectifying plate from the middle of the cover of the rotary cup and at the same time the cleaning liquid is supplied on a lower surface of the outer peripheral portion of the rectifying plate, the inner side surface of the covered rotary cup and the bottom of the stationary cup and thereby the cleaning liquid supplied from the middle of the cover of the rotary cup is sprayed outwardly by a centrifugal force caused by the rotating rectifying plate to remove a coating liquid adhered on the lower surface of the cover, and the coating liquid adhered to the lower surface of the outer peripheral portion of the rectifying plate, the inner side surface of the rotary cup and the bottom surface of the stationary cup is removed by the cleaning liquid directly supplied thereto.

Besides, the coating liquid adhered on a lower surface of the outer peripheral portion of the rotary cup and the inner side surface of the stationary cup can be removed by supplying the cleaning liquid thereon. In this case, the lower part of the inner side surface of the stationary cup can be formed in such a manner that the inner side surface of the stationary cup is bent outwardly and thereby there can be produced a stagnant space of an air stream flowing a gap between the rotary cup and stationary cup, so that the coating liquid is held up in the stagnant space and prevented to flow back upwardly. Moreover, the coating liquid adhered on the stationary cup can be removed by supplying the cleaning liquid from the third nozzle toward the bent portion of the inner side surface of the stationary cup.

When the cleaning liquid is supplied toward the rectifying plate from the middle of the cover of the covered rotary cup, while rotating the covered rotary cup at the first rotational speed, for example in the range of 350 to 650 rpm, the cleaning liquid is forced impinge on a lower surface of the outer peripheral portion of the cover by an centrifugal force caused by a rotation of the rectifying plate which rotates together with the rotary cup and thereby the coating liquid adhered on the lower surface of the cover can be removed. When the cleaning liquid is supplied toward a lower surface of the outer peripheral portion of the rectifying plate and the inner side surface of the covered rotary cup while rotating the covered rotary cup at a rotational speed, for example in the range of 700 to 1300 rpm, the cleaning liquid can be supplied with a good efficiency over a broad surfaces covering the lower surface of the outer peripheral portion of the rectifying plate and the inner side surface of the rotary cup. When the cleaning liquid is supplied on the bottom surface of the covered rotary cup and a target area of a stream thereof is moved from the middle to the outer peripheral, while rotating the covered rotary cup at a rotational speed, for example in the range of 14 to 26 rpm, the coating liquid adhered on the bottom can be removed.

Additional objects and advantages of the invention will be set forth in the description which follows and in part will be obvious from the description, or may be learned by practice of the invention. The objects and advantages of the invention may be realized and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Embodiments of the present invention will be in detail in reference to the attached drawings.

Figure 1:
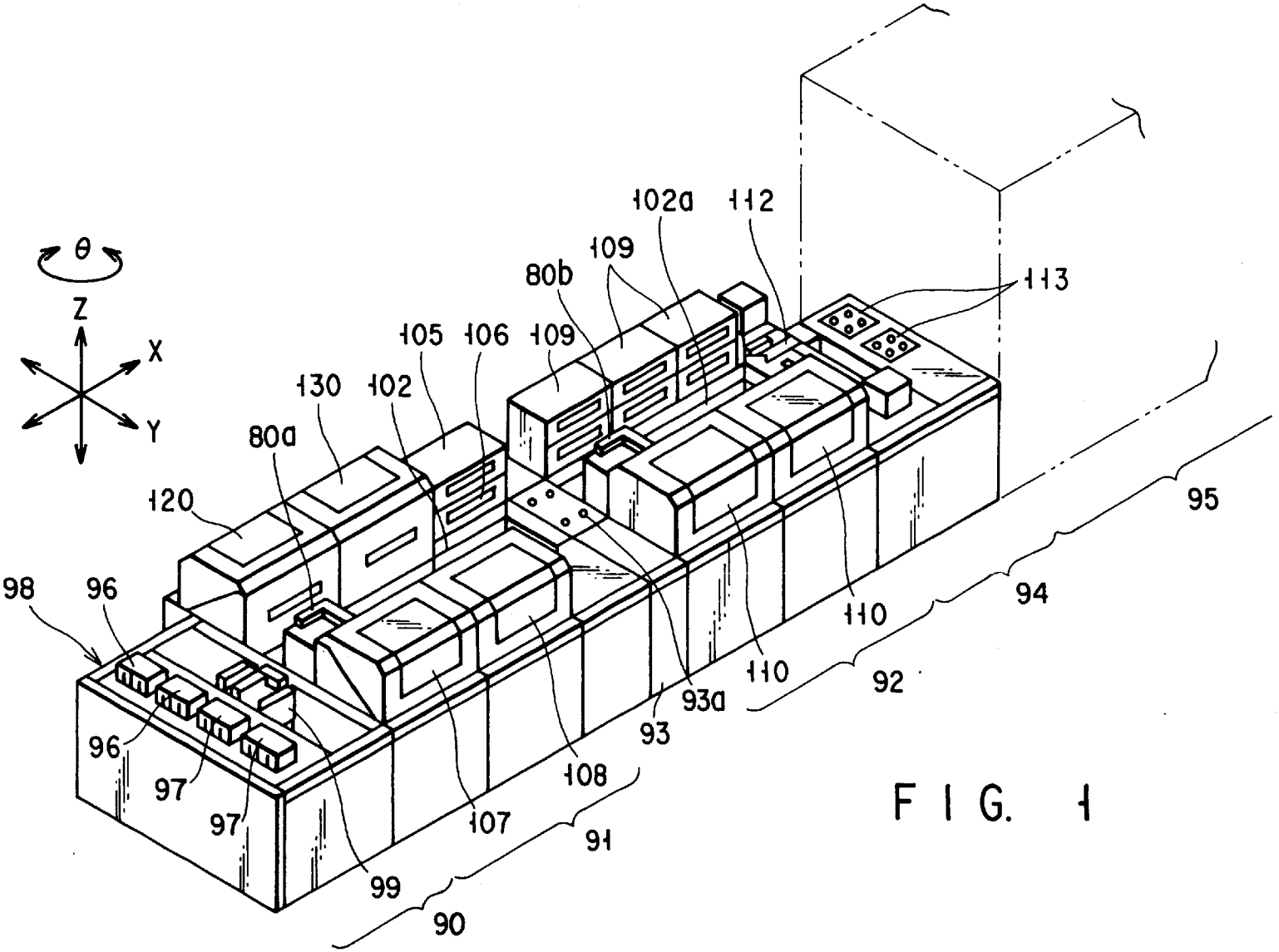
FIG. 1 is a perspective view showing a construction of a LCD substrate treatment system according to an embodiment of the present invention.

FIG. 1 is a view showing a construction of a coating/developing system for a LCD substrate (hereafter referred to as LCD substrate treatment system) according to a first embodiment of the present invention.

As shown in the figure, the LCD substrate treatment system comprises: a loading section 90 in which an object to be treated, for example a rectangular LCD glass substrate G (hereinafter referred to glass substrate G) is transported in or out, a first treatment section 91 in which the glass substrate G is treated, a second treatment section 92 which is connected with the first treatment section 91 with an intermediate section 93 lying therebetween and a transfer section 94 for feeding or receiving a glass substrate G between the second treatment section 92 and another apparatus, for example an exposure apparatus 95.

In the loader 90, a cassette stage 98 is installed. A plurality of cassette 96, 97 are mounted on the cassette stage 98, a plurality of untreated glass substrates G are accommodated in the cassette 97. A pincette 99 for transporting in or transporting out unused glass substrates is disposed in the loading section 99.

The first treatment section 91 comprises: a brush cleaning apparatus 120, a jet water cleaning apparatus 130, an adhesion treatment apparatus 105, a cooling treatment apparatus 106, a pair of resist coating/removing apparatuses 107, 108. In the central passage in the first treatment section 91, 80*a* is disposed in a manner that it is free to run or stop.

The second treatment section 92 comprises a plurality of heating treatment apparatuses 109; and a pair of developing apparatuses 110. In the central passage in the second treatment 92, a main arm 80*b* is equipped in a manner that it is free to run or stop. In the second treatment section 92, a pincette 112 for transporting in or transporting out a glass substrate G is installed. In an intermediate section 93, a table 93*a* for forwarding or receiving a glass substrate G is installed. In a forwarding/receiving section 94, a table 113 for forwarding or receiving a glass substrate G is installed. The exposure apparatus 95 is used to expose a fine pattern on a resist film.

Figure 2:
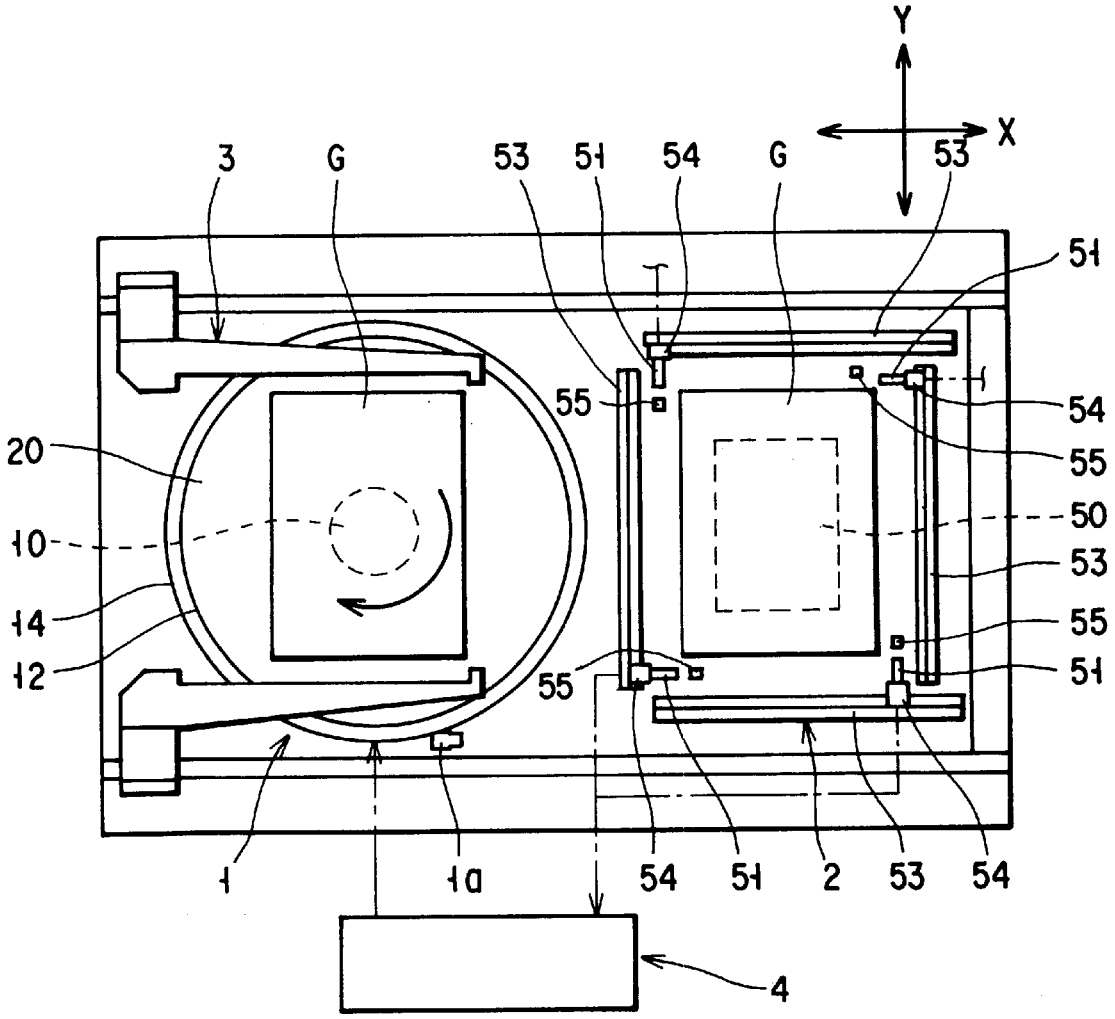
FIG. 2 is a view showing a structure of a resist coating/removing apparatus of a LCD substrate treatment system.

As shown in FIG. 2, each of the resist coating/removing apparatuses 107, 108 comprises: a coating mechanism 1 for coating the surface of a glass substrate G with a coating liquid, for example a resist liquid, which is supplied from a coating liquid supply nozzle 1*a*; an edge removing mechanism 2 for removing an unnecessary coating film formed on the peripheral portion of the glass substrate G, wherein the coating mechanism 1*a* and the edge removing mechanism 2 are disposed in a adjoining manner, in other words both mechanisms 1 and 2 are contained in the same atmosphere as one body; a cleaning treatment apparatus 4 as a circulating system in which the cleaning liquid used in the edge removing mechanism 2, for example a thinner which is a solvent for a resist liquid, is recovered and the thinner is circulated for cup cleaning in the coating mechanism 1; and a transportation mechanism 3 for transporting the glass substrate G already coated with the resist by the coating mechanism 1 to the edge resist removing mechanism 2. In the edge removing mechanism 2, guide rails 53 are disposed in an extending manner in an X or Y direction, a plurality of sliding members 54 mounted on the guide rail 53 in a manner that the sliding member 54 is free to slide. A sliding member 54 comprises: a wire; a chain; a belt; a ball screw; and an moving mechanism using a stepping motor and an air cylinder and is constructed so that it can be freely movable in an X or Y direction. Each slide member 54 is mounted with a resist removing nozzle 51 which is a constituent of the edge removing mechanism 2. Moreover, in the vicinity of each of cross sections of guide rails 53 there is located a sensor 55 which detects an adjacent position of a resist removing nozzle 51 so that adjacent resist removing nozzles 51 are not mutually interfere, that is do not collide with each other. With this sensor, it is detected that the adjacent removing nozzle 51 approaches to another resist removing nozzle 51, which detecting signal is transmitted to a control section, which is later described, and driving of the moving mechanism is stopped by a control signal from the control section, so that adjacent resist removing nozzles 51 are prevented from an interference, that is collision therebetween.

Figure 3:
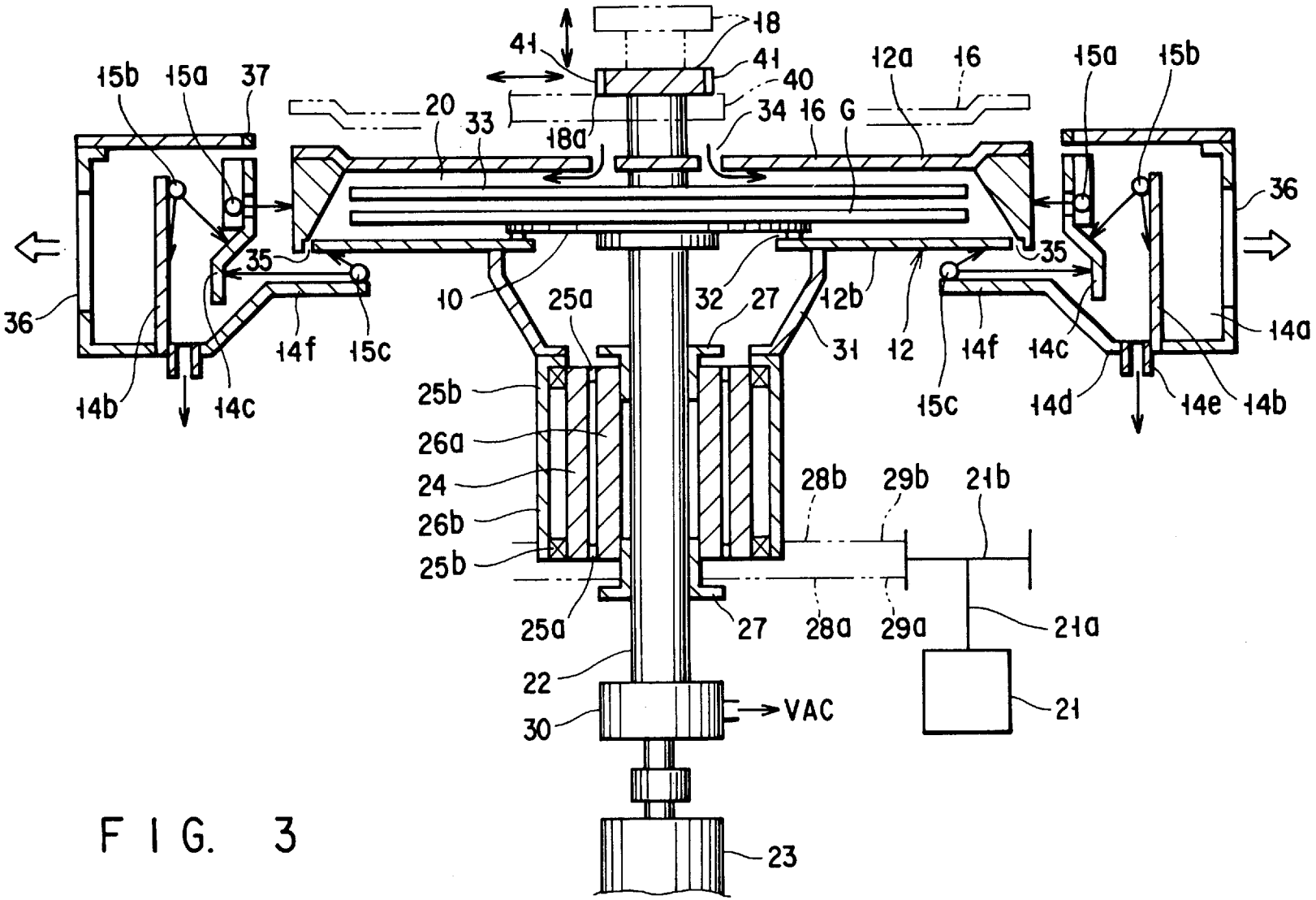
FIG. 3 is a sectional view showing a coating mechanism of the resist coating/removing apparatus.

As shown in FIGS. 2 and 3, the coating mechanism 1 mainly comprises: a spin chuck 10, which is rotatable in a horizontal plane (θ direction), and on which a glass substrate G is vacuum-chucked by a vacuum. apparatus not shown; a rotary cup 12 having a cylindrical form with a ceiling and bottom with respective openings, which further comprises a treatment room 20 which encloses the upper portion of the spin chuck 10 and its outer peripheral portion; a cover 16 which is freely mounted/demounted so that a opening 12*a* of the rotary cup 12 is freely closed/opened; and a drainage cup 14 having a shape of a hollow ring., which is disposed in a surrounding manner outside the rotary cup 12. The drainage cup 14 is to receive and collect a waste from the rotary cup 12. The treatment room 20, rotary cup 12, cover 16 and drainage cup 14 constitute a vessel for recovering a treatment liquid or a cleaning liquid.

The spin chuck 10 is freely rotatable in a horizontal plane about a rotary shaft 22 by rotation of the shaft 22 which is driven by a drive motor 21 disposed in a lower position and besides shiftable in vertical directions by the rotary shaft 22 which is connected to a vertical shift cylinder 23, and driven by the vertical shift cylinder 23. In this case, the rotary shaft 22 is slidably connected to a spline bearing 27 which is fittingly inserted in a rotary inner cylinder 26*a* which is in turn inserted rotatably in a stationary collar 24 with the help of a bearing 25*a* therebetween. A driven pulley 28*a* is mounted on the spline bearing 27 and a belt 29*a* is extended between the driven pulley 28*a* and a driving pulley 21*b* which is fixed on a drive shaft 21*a* of a drive motor 21. Accordingly, the spin chuck 10 is rotated by rotation of the rotary shaft 22 which is rotated by the drive motor 21 with the help of the belt 29*a* as an intermediate. In a lower portion than the rotary shaft 22 there are located a cylindrical tube not shown. In the cylindrical tube the rotary shaft 22 is connected to the vertical shift cylinder 23 through a vacuum seal 30 and the rotary shaft 22 is driven to move vertically by being driven by the vertical shift cylinder 23.

The rotary cup 12 is indirectly mounted on the upper end of a rotary outer cylinder 26*b* with a connecting cylinder 31 fixedly mounted on the upper end of the rotary outer cylinder 26*b* in a direct relation, the rotary outer cylinder 26*b* being mounted on the outer peripheral surface of the stationary collar 24. The rotary cup 12 and the spin chuck 10 are rotatable relative to each other with a bearing 32 having a sealing function between the bottom 12*b* of the rotary cup 12 and the lower surface of the spin chuck 10. The driving from the drive motor 21 is transferred to the rotary cup 12 with the help of the belt 29*b* which extends between the driven pulley 28*b*, which is fixedly mounted on the rotary outer cylinder 26*b*, and the drive pulley 21*b* mounted on the drive shaft 21*b* of the drive motor 21. In this case, a diameter of the driven pulley 28*b* is made so as to be equal to that of the driven pulley 28*a* which is fixedly mounted on the rotary shaft 22 and the belts 29*a*, 29*b* are engaged with the same motor 21 and thereby the rotary cup 12 and the spin chuck 10 are rotated at the same speed. A labyrinth seal section (not shown) is provided between the opposed surfaces of the stationary collar 24 and the rotary inner cylinder 26*a* and dust is prevented from invasion into the inside of the rotary cup 12 from a driving system located in a lower portion when the rotary cup 12 is working. Different rotational speeds can be selected by adopting different diameters of the driven pulleys 28*a*, 28*b*.

Figure 4:
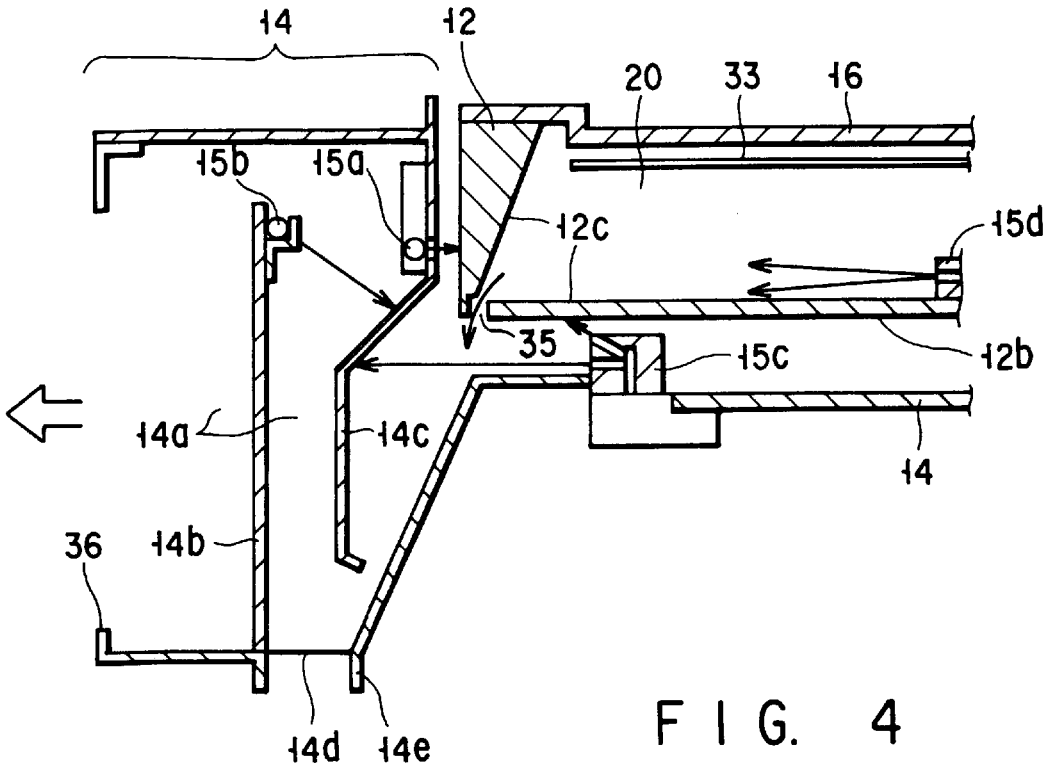
FIG. 4 is an enlarged sectional view of a vessel (a treatment room, a rotary cup and a drainage cup) of the coating mechanism of FIG. 3.

As shown in FIGS. 3 and 4, the rotary cup 12 has a tapered inner side wall and the inner diameter of the rotary cup 12 is decreased upwardly. The reason why is because an air stream supplied from an air supply port 34 which is bored in the middle portion of the cover 16, when the rotary cup is working, flows on and along the rectifying plate 33, which is arranged under the cover 16, further flows downwardly along the tapered side wall and then is discharged from the exhaust port 35 which are disposed at proper positions in the lower peripheral portion, that is on the lower portion of the side wall.

With such circumstances wherein the air supply port 34 and exhaust port 35 are provided, the air stream from the air supply port 34 into the treatment room 20 flows out from the exhaust port 35 to the outside and thereby it is prevented that the treatment room is reduced in excess of a necessary negative pressure while the rotary cup 12 is rotated. Besides, a large force is unnecessary to open the cover 16 from the rotary cup 12 after the treatment is terminated and the cover 16 can take away with ease.

On the other hand, as shown in FIG. 4, a ring like passage 14*a* is formed in the drainage cup 14 and exhaust ports 36 are formed at proper positions on the outer wall of the ring like passage 14*a* (for example, at four positions along a periphery) and the exhaust ports 36 are connected with an exhausting apparatus not shown. Furthermore, exhaust passages 37 are formed in a radiating manner in the upper portion of the inner wall of the drainage cup 14, the exhaust passages 37 being communicated with the exhaust ports 36 (see FIG. 3).

In such a manner, since the exhaust ports 36 are provided on the outer side wall of the drainage cup 14 and the exhaust passages 37 are formed in the upper portion of the inner side wall of the drainage cup 14, a mist flying away under an influence of a centrifugal force and flowing into the drainage cup 14 through the exhaust ports 35 when a rotational treatment is performed is prevented from flying upwardly to an upper portion of the rotary cup 12 and the mist is discharged through the exhaust ports 36.

The ring like passage 14*a* is partitioned by the erected wall at the bottom of the drainage cup 14 and a depending wall 14*c* at the ceiling portion of the drainage cup 14 to form a detour and exhaust an air in a uniform manner and besides drainage holes 14*e* are formed on the bottom between the walls 14*b* and 14*a* in a proper distance along a periphery.

While the cover 16 is required to be fixed to the opening 12*a* of the rotary cup 12 and to be rotated in a body during a rotational treatment, for example, fixed pins (not shown) planted on the top surface of the rotary cup 12 and engaging holes in the corresponding positions of the cover 16 (not shown) to be engaged with the fixed pins are provided and can be mutually engaged with each other so as to keep the cover 16 and rotary cup 12 fixed to each other.

When the cover 16 is opened or closed, as shown with fictitious lines in FIG. 3, a robot arm 40 is inserted under an expanded head 18 protruded on the upper surface of the cover 16, besides engage pins protruding from the robot arm 40 are fittingly inserted into engaging grooves 18*a* and thereafter the robot arm 40 is moved vertically or laterally to move the cover 16. In order to facilitate the positioning between the engaging grooves 18*a* in the expanded head 18 and the engaging pins 41 of the robot arm 40 when the cover is opened, and the positioning between the fixed pins and the engaging holes when the cover 16 is closed, the positioning in both cases can be effected by controlling an angle of rotation of a servo motor as the drive motor 21.

On the other hand, as shown in FIGS. 3 and 4, there are mounted a thinner supply nozzle 15*a* as a first jet section for jetting a cleaning liquid, for example an unused thinner toward the inner wall surface 12*c* of the rotary cup 12 in the treatment room 20. There are mounted a thinner supply nozzle 15*c* as a second jet section on the horizontal strip 14*f* of the bottom of the drainage cup 14 extending under and along the rotary cup 12 for jetting (supplying) a thinner toward the lower part of the outer side surface of the rotary cup 12 and the inner side wall 14*c* of the drainage cup 14. A thinner supply nozzle 15*a* as a second jet section is mounted on the wall 14*c* of the drainage cup 14 for jetting a cleaning liquid, for example a recycled thinner, toward the outer side of the rotary cup 12. Moreover, a thinner supply nozzle 15*b* as the second jet section is mounted on the wall 14*b* of the drainage cup 14 for jetting a cleaning liquid, for example a recycled thinner toward the outer side of the wall 14*c* and the inner side of the wall 14*b*. These thinner supply nozzles 15*a*, 15*b*, 15*c* are mounted along peripheries at a proper distance.

The rotary cup 12 and the drainage cup 14 are made of, for example a stainless sheet (SUS 304) and the like. While this plate is selected in order to form a coating film made of one of a specified materials shown in the following table, as a substrate for a coating portion, it is not restricted to SUS 304 but, for example, a resin or a metal may be used instead.

Figure 5:
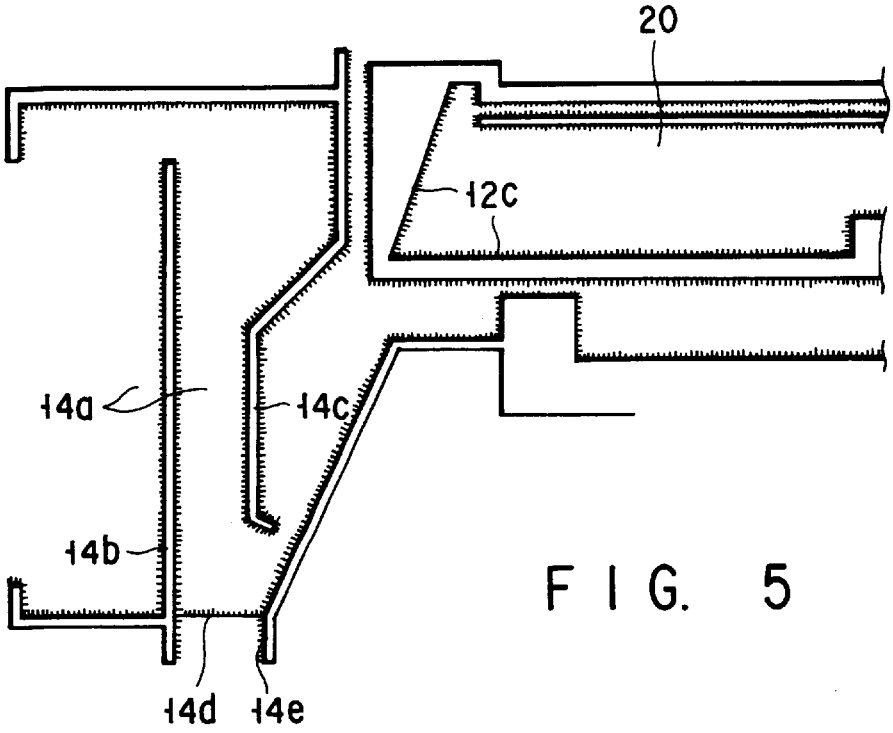
FIG. 5 is a view showing coating of ethylene fluoride based resin on surfaces in the vessel of FIG. 4.

As shown in FIG. 5, surfaces in the treatment room 20 and the ring like passage 14*a* which surfaces are contacted with a treatment liquid or a cleaning liquid (shown as a portions on whose surfaces short oblique lines are hatched), for example the inner wall surfaces 12*a*, 12*b* of the rotary cup 12, the inner surface of the cover 16, the front and rear surfaces of the rectifying plate 33, wall surfaces inside the ring like passage 14*a* of the drainage cup 14 (both surfaces of each of walls 14*b*, 14*c*, the inner surface of the bottom 14*d* and the inner surface of the drainage 14*e* and the like) are coated with a film of a thickness about 60 μm made of such a coating material as ethylene fluoride based resin, for example polytetrafluoroethylene (PTFE).

TABLE 1

| No. of Example | Material (coating) | Contact Angle (°) Pure Water | Resist TFP-670 (15CP) (15CP) PGMEA | Adhesion Test of Resist (Film Thickness μm) |
|---|---|---|---|---|
| 1 | SUS 304 Adrasive | 12 49.4 (22.8 + 22.6) | 12 17.0 | 12 Resist Adhered (7.1 μm) |
| 2 | SUS 304 Affixed Teflon Tape | 5 103.5 (51.7 + 51.8) | 7 55.6 | 1 4 to 5 Particles Adhered (–) |
| 3 | PFA | 8 88.6 (44.9 + 43.7) | 8 55.0 | 1 4 to 5 Particles Adhered (–) |
| 4 | PTFE | 7 99.7 (50.3 + 49.4) | 6 58.7 | 6 11 Particles Adhered (–) |
| 5 | SUS 304 PTFE + PFA (100 μm) | 6 101.8 (50.4 + 51.4) | 6 57.9 | 1 4 Particles Adhered (–) |
| 6 | SUS 304 PTFE (60 μm) | 1 125.3 (63.1 + 62.3) | 2 60.4 | 1 4 to 5 Particles Adhered (–) |
| 7 | SUS 304 Tough Coat (40 μm) | 2 121.3 (60.3 + 61.3) | 3 59.6 | 7 50 to 60 Particles Adhered (–) |
| 8 | SUS 304 6F (FEP) (250 μm) | 3 112 (54.7 + 57.3) | 4 59.2 | 1 3 Particles Adhered |
| 9 | SUS 304 2F (60 μm) | 10 80.4 (40.4 + 40.4) | 11 22.6 | 9 Resist Adhered (4.7 μm) |
| 10 | SUS 304 Silicone (60 μm) | 4 77.0 (38.3 + 38.7) | 9 37.6 | 11 Resist Adhered (6 μm) |
| 11 | Aluminum-toughram (30 μm) | 4 109.1 (54.3 + 54.8) | 1 61.1 | 8 Resist Adhered (8.1 μm) |
| 12 | Aluminum electroless Ni plating | 11 72 (35.8 + 36.2) | 10 25.4 | 10 Resist Adhered (5.3 μm) |

| No. of Example | Magic Ink Stain ◎: well wiped off ○: wiped off Δ: trace left X: not erased | Chemical Resistance PEGMEA 9/17 START | Developer 9/12 START | Residue Nozzle 9/12 START | MEK 9/12 START | OK73 9/12 START | Hardness | Coating Particle Size (¥/dm²) |
|---|---|---|---|---|---|---|---|---|
| 1 | 8 X | ○ | ○ | ○ | ○ | ○ | — | — |
| 2 | 2 ◎ | — | — | — | — | — | — | — |
| 3 | 1 ◎ | ○ | ○ | ○ | ○ | ○ | less than 3H | — |
| 4 | 4 ○ | ○ | ○ | ○ | ○ | ○ | less than 3H | — |
| 5 | 3 ◎ | ○ | ○ | ○ | ○ | ○ | less than 3H | 410 |
| 6 | 6 Δ | ○ | ○ | ○ | ○ | ○ | less than 3H | 240 |
| 7 | 8 X | ○ | ○ | ○ | ○ | ○ | less than 3H | 240 |
| 8 | 6 Δ | ○ | ○ | ○ | ○ | ○ | less than 3H | 570 |
| 9 | 8 X | ○ | 9/17 X | ○ | 9/17 X | ○ | 4H | 240 |

TABLE 1-continued

| | | | | | | | | |
|---|---|---|---|---|---|---|---|---|
| 10 | ⑧ X | 9/21 X | X | 9/17 X | 9/17 X | 9/17 X | less than 3H | 240 |
| 11 | ⑦ X | ○ | 9/13 X | ○ | ○ | ○ | 5H | 300 |
| 12 | ⑧ X | ○ | 9/13 X | ○ | ○ | ○ | 5H | 150 |

Table 1 shows results of an adhesion test (contact angle), resist attachment test, a wipe-off test (magic ink stain), a chemical resistance test and a hardness test conducted on examples of combinations of plate materials and coating materials (Examples 1 to 12) and the table includes prices corresponding to respective test results. As can be seen from the results of the table, the best combination of a plate material and a coating material is that of Example 6.

The example 6 is an example in which PTFE as a coating material was coated as film with a thickness of 60 μm on the surface of SUS 304 as a plate material. In this case, an angle of contact of pure water has shown 25.3°, which is the largest, resist adhesion is as small as 4 to 5 particles and a degree of resist adhesion (degree of close contact) is very low, compared with other examples.

Other than the example 6, a combination of the example 5 can be used, in which a copolymer of PTFE and ethylene (PTFE+PFE) is coated as film of a thickness of the order of 100 μm on SUS 304, results shows that an adhesion test (contact angle of pure water) is inferior to the example 6, but a resist attachment test and a wipe-off test are better than the example 6. That is, it has been confirmed that the cases where inner wall surfaces of the treatment room 20 and the ring like passage 14 are coated with an ethylene resin has a small amount of residual resist on coated portions and show better results.

The edge removing mechanism 2 shown in FIG. 2 comprises: a mounting table 50 for vacuum-holding a glass substrate by means of a vacuum apparatus not shown and four removing nozzles 51 for jetting a cleaning liquid, for example a thinner as a resist solvent on the upper and lower surfaces of the outer periphery of the four sides of the glass substrate held by the mounting table 50.

Figure 6:
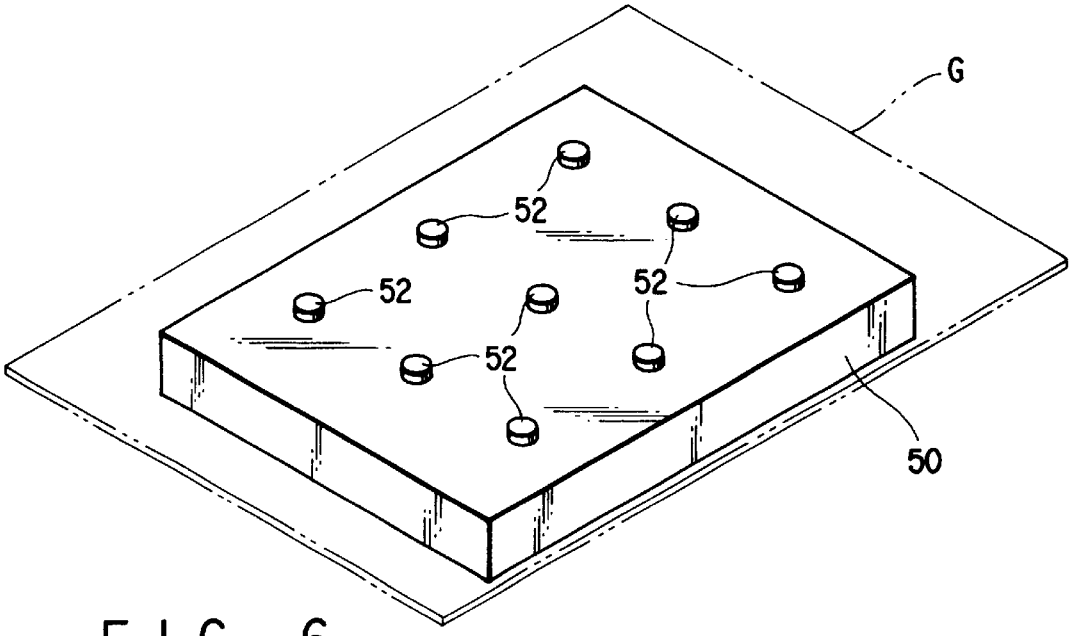
FIG. 6 is a schematic perspective view showing the top surface of a mounting table.

As shown in FIG. 6, a plurality of, for example, nine copying pads 52 holding the glass substrate G are attached on the upper surface of the mounting table 50.

Figure 7:
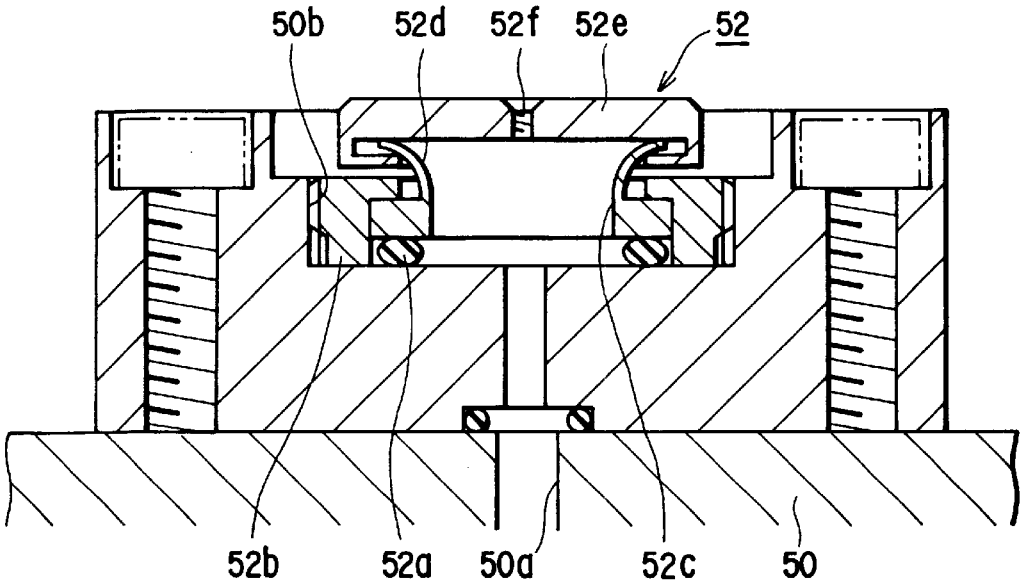
FIG. 7 is an enlarged view in section of a main portion of FIG. 6.

As shown in FIG. 7, a pad 52 is constructed of an oil seal 52*c* having the shape of almost a crown fixed by a ring-nut 52*b* for pressing by way of a packing 52*a* in a stepped recess 50*b* located along a periphery outside a vacuum hole 50*a* formed in the mounting table 50 in a manner to cover the vacuum hole 50*a*; and a top pad 52*e* having a suction hole 52*f* in the central portion which pad is engaged with an upper portion 52*d* of the oil seal 52*c* in a movable manner. With such a construction, when the glass substrate G is mounted on the top pad 52*e* and a vacuum apparatus is driven for suction, the top pad 52*e* is forced to a close contacting condition while conforming with an inclination or deformation of the glass substrate G to vacuum hold the glass substrate G with security.

Figure 8:
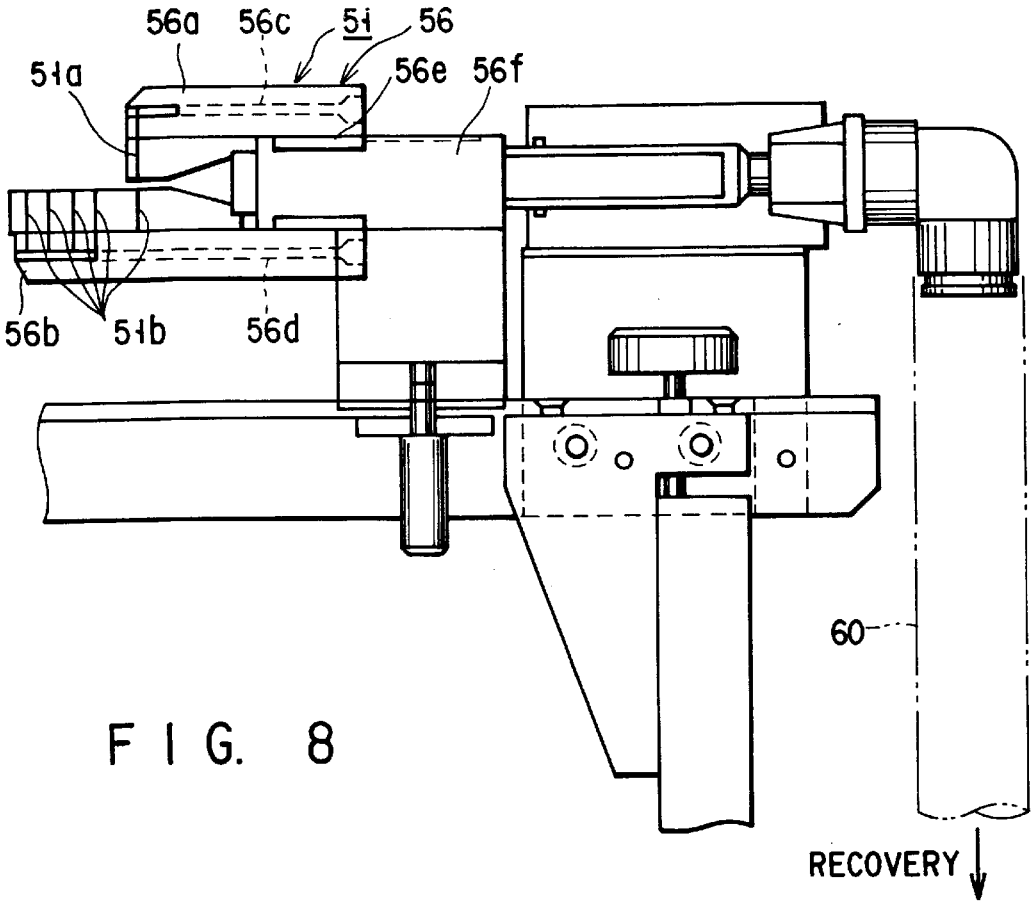
FIG. 8 is a sectional view of an edge removing mechanism.

As shown in FIG. 8A, a removing nozzle 51 is constructed of: an upper horizontal strip 56*a* which covers the upper surface of the peripheral portion of the glass substrate G; and a jetting head 56 having the shape like a Greek Π in section comprising a lower horizontal strip 56*b* protruding outwardly of the upper horizontal piece 56*a*. In the upper horizontal piece and lower horizontal strip 56*b* of the jetting head 56, thinner supply path 56*c* for removing a resist on the front surface and a thinner supply path 56*d* for removing a resist on the rear surface. A plurality of nozzle holes 51*a* for cleaning the front surface and a plurality of nozzle holes 56*b* are respectively connected to the thinner supply paths 56*c* and 56*b*. In a vertical portion 56*e* of the jetting head 56, a discharged liquid path 56*f*, which is connected with a recovering pipe 60 later described, is disposed along a central line C. The opening 56*g* near the side of a substrate edge portion of the discharged liquid path 56*f* is formed in a shape having a taper and in such a manner that a diameter of the discharged liquid path 56*f* increases in width toward the opening.

Figure 9A:
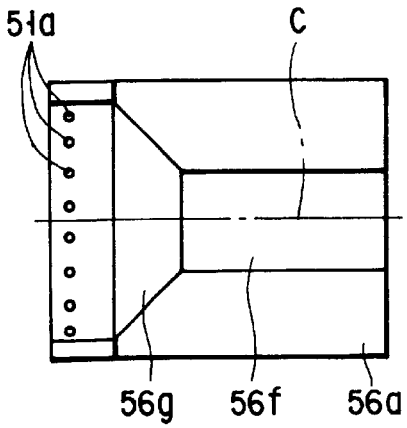
FIG. 9A is a plan view showing nozzle holes for a front surface of the edge removing mechanism of FIG. 8.

As shown in FIG. 9A, a plurality of nozzle holes 51*a* are arranged at a proper distance on a line perpendicular to the central line C of a removing nozzle 51. In this case, the nozzle holes 51*a* are disposed at positions other than the central line C and inside of the expanding tapered opening 56*g* of the discharged liquid path 56*f*.

Figure 9B:
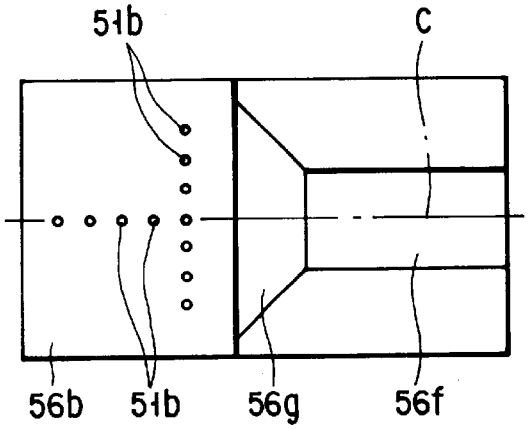
FIG. 9B is a plan view showing nozzle holes for a rear surface of the edge removing mechanism of FIG. 8.

On the other hand, as shown in FIG. 9B, a plurality of nozzle holes 51*b* are arranged on a straight line opposed to the nozzle holes 51*a* at positions with a proper distance therebetween in such a manner that the nozzle holes 51*a* and 51*b* do not interfere therebetween and inside the opening of the expanding tapered opening 56*g*. The reason why the nozzle holes 51*a* and 51*b* are arranged in an offset manner is that, while jet streams from the nozzles 51*a* and 51*b* collide against each other, a thinner is scattered around and the scattered thinner is then attached on a resist film of the surface of the glass substrate G, which gives a wrong influence such as non-uniformity of a film thickness of the resist film, it is to prevent such a wrong influence. Besides, with the expanding tapered opening 56*g* inside which the nozzle holes 51*a* and 51*b* are disposed, thinners fed or supplied from the nozzle holes 51*a* and 51*b* can be recovered into the covering pipe 60 through the discharged liquid 56*f* with a good efficiency without a thinner sprayed away outwardly.

Figure 10:
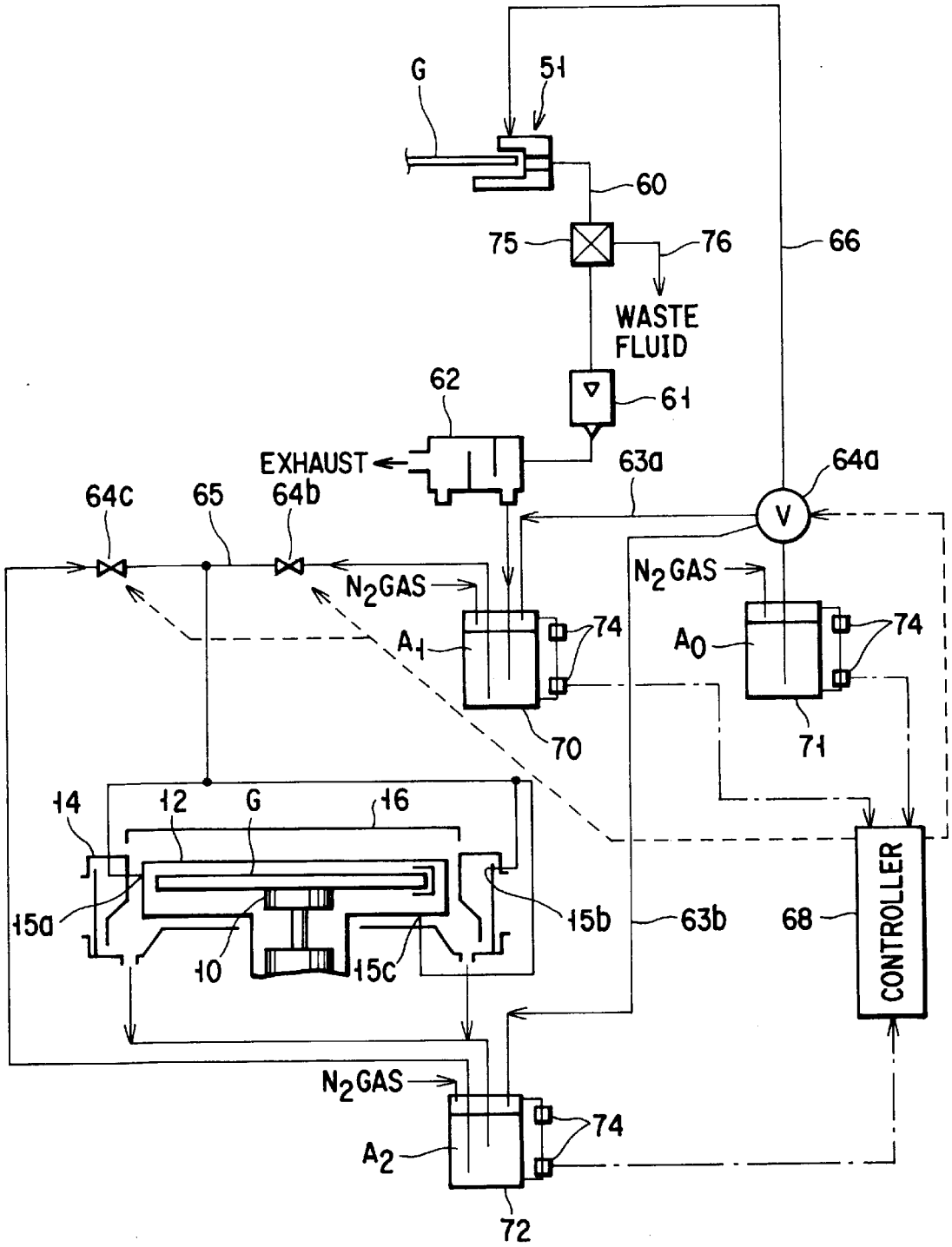
FIG. 10 is a view showing a first apparatus for a cleaning treatment.

As shown in FIG. 10, the apparatus for a cleaning treatment 4 comprises: a recovering pipe 60 recovering a thinner jetted toward both surfaces of a glass substrate G already having a resist film formed by a resist removing nozzles 51 through a discharged liquid path 56*f* of resist removing nozzles 51; a suction mechanism 61 connected with the recovering pipe 60 with a selector valve 75 in the way therebetween; a mist tap 62 as a gas/liquid separation means for effecting gas/liquid separation from a mixture of a thinner and air recovered by the suction mechanism 61; an edge remover tank (hereinafter referred to as ER tank 70) as a first discharged liquid storing section for storing a thinner A1, which is already used, and which is separated from the mist trap 62; a valve 64*a* connected to the ER tank 70 with a supplement supply pipe 63*a* therebetween; a fresh liquid tank 71 storing an unused thinner A0 (a fresh liquid) and connected to the valve 64; a thinner re-supply pipe 65 supplying a used thinner A1 (for a recycle use) to thinner supply nozzles 15*a* to 15*c* with the valve 64 interposing therebetween from the ER tank 70; a fresh liquid supply pipe 66 supplying the unused thinner A0 to removing nozzles 51 from the fresh liquid tank 71; a DR tank as a second discharged liquid storing section storing a thinner A2 (a discharged liquid) which is already used (a recycle use) and which is discharged from drainage holes 14*e*; a supplemental supply pipe 63*b* supplementing with the unused thinner A0 (a fresh liquid) from the fresh tank 71 with a connection between the DR tank 72 and the valve 64*a*; a valve 64*c* interposed between the DR tank and the thinner re-supply pipe 65; a liquid level sensor 74 installed in the tanks 70, 71, 72 detecting the liquid level of the thinner stored in the respective tanks; and a control section 68 in such a manner that valves 64*a* to 64*c* and the selector valve 75 are respective controlled based on the information on the liquid levels detected by the liquid level sensor 74, thereby intakes of the thinner of the respective tanks 70, 71, and 72 and further a moving mechanism not shown is controlled based on the detecting information in the sensor 55 detecting the position of the removing nozzles 51.

The ER tank 70 and the DR tank 72 are connected with the thinner supply nozzles 15*a* to 15*c* with the help of a thinner re-supply pipe 65, an inert gas, for example nitrogen gas (hereinafter referred to as N2 gas) are supplied from an inert gas supply source not shown to the tanks 70, 72, the thinners A1, A2 in the tanks 70, 72 are jetted from the thinner supply nozzles 15*a* to 15*c* to the inside of the treatment room 20, the inner and outer wall of the rotary cup 20 and the wall surfaces of the drainage cup 14 by a pressure of N2 gas in the tanks 70, 72, while a degree of opening of the valves 64*b*, 64*c* is adjusted. The thinners A1, A2 may be supplied by the use of pumps instead of N2 gas to the thinner supply nozzles 15*a* to 15*c*.

The liquid level sensor 74 detects liquid levels of the ER and DR tanks 70, 72 when the thinners therein are decreased to a level more or less than the predetermined quantities and detected information is transmitted to the control section 68 as a liquid level detecting signal and degrees of opening of the valves 64*a* to 64*c* are controlled based on the liquid level detecting signal by the control section 68. The control section 68 controls the selector valve 75 to discharge an unused thinner at the beginning of recovery (a thinner with a resist of a relatively higher concentration) from the removing nozzles 51 in the edge removing mechanism 2 through the discharged liquid pipe 76 and thereafter the control section 68 switches flow to another direction to send the thinner to the side of suction mechanism 61, whereby recovery is conducted on the thinners which is suitable for recovery.

Here, the outline of operation of the LCD substrate treatment system will be described.

In this LCD substrate treatment system, a used glass substrate G accommodated in a cassette 96 are taken out by the take-in pincette of the loading section 90, the glass substrate G is transferred to the main arm 80 which moves on the transport path 102 of the first treatment section 91, and transported into the brush cleaning apparatus 120. The glass substrate G cleaned in this brush cleaning apparatus 120 is subsequently cleaned by a high pressure jet water in the jet water cleaning apparatus 130. Thereafter, the glass substrate G is subjected to a process in which the glass substrate G is made hydrophobic in the adhesion treatment apparatus 105, cooled by the cooling treatment apparatus 106 and thereafter a resist film is formed by the coating mechanism 1 in the resist coating/removing apparatuses 107, 108. Subsequently, the glass substrate is transferred to the adjacent the edge removing mechanism 2 side to remove an unnecessary part of the resist film in the peripheral area of the glass substrate G by the edge removing mechanism 2. Accordingly, in the following stages, when the glass substrate G is transported out, the main arms 80*a*, 80*b* and the like are not attached with a resist, since the resist film in the peripheral area is removed. A discharged liquid which is used for removing unnecessary resist in the edge removing mechanism 2 and is contaminated with a resist, is recovered into the mist trap 62 by way of the recovering pipe 60, and a liquid ingredient only, that is a thinner, is recovered by subjecting the recovered discharged liquid to a gas/liquid separation process and is stored in the ER tanks 70. The thinner stored in the ER and DR tanks 70, 72 are again used to clean cups of the resist applying/removing apparatuses 107, 108 using the apparatus for a cleaning treatment 4.

The glass substrate G from which unnecessary resist has been removed in the resist coating/removing apparatuses 107, 108 is tranferred to the heat treatment apparatus 109 to subject the glass substrate G to a baking treatment by heating, and thereafter a predetermined pattern is exposed on the surface of the glass substrate G in the exposure apparatus 95. The exposed glass substrate G is accepted by the main arm 80*b* moving along the transport path 102*a* of the second treatment section 92, transferred into the developing apparatus 110, after being developed the glass substrate G is rinsed with a rinse liquid to wash out the developer and then a developing treatment is finished. The glass substrate G already treated in the developing treatment is accommodated in the cassette 97 in the loading section 97 and transported out to next treatment step.

Next, Actions (cleaning and circulation operations) in the apparatus 4 for a cleaning treatment above mentioned will be described.

A glass substrate G subjected to a coating treatment in the coating mechanism 1 is transported on the mounting table 50 of the edge removing mechanism 2 by the transport mechanism 3 to be held by vacuum suction.

The moving mechanism of the removing nozzles 51 is driven to move the removing nozzles 51 arranged along the sides in a direction of X or Y and at the same time the thinner A0 is supplied to the nozzle holes 51*a*, 51*b* from the fresh liquid tank 71 to be jetted in order to dissolve and remove the unnecessary resist attached on both surfaces of the peripheral portion of the glass substrate G. The thinner used for cleaning is made to flow into the recovering pipe 60 on an air stream produced by suction of the suction mechanism 61 and recovered into the mist trap 62 through the selector valve 75 and the suction mechanism 61. In this case, the thinner used at the beginning of cleaning is discharged from the discharged liquid pipe 76 by switching of the selector valve 75.

The thinner (a discharged material) recovered in the mist trap 62 is mixed with air (gas) and therefore the air (gas) only is removed (exhausted) to the outside by an exhausting function of the mist trap 62 and the liquid ingredient only is stored in the ER tank 70 by its own weight.

When the stored quantity of a thinner in the ER tank 70 is increased, a liquid level of the thinner goes upward and the level is detected by the liquid level sensor 74, which is disposed at an upper portion of the ER tank 70, the information is transmitted to the control section 68.

The control section 68 sends a control signal to the valve 64*b* to open the valve 64*b* and at the same time N2 gas is supplied into the ER tank 70 from the N2 supply source not shown and the thinner A1 in the ER tank 70 is supplied through the thinner re-supply pipe 65 to the thinner supply nozzles 15*a* to 15*c* by a pressure increased by the supplied N2 gas, the thinner A1 is jetted (supplied) through the thinner supply nozzles 15*a* to 15*c* on the outer side surface of the rotary cup 12 and the inner side surface of the drainage cup 14 to effect a cup cleaning.

In such operations performed as mentioned above, traces of the resist attached on the walls of the treatment room 20, the rotary cup 12 and drainage cup 14 are dissolved and removed, the attachment of the resist is made by the flying away during the time of a resist coating treatment. Since PTFE is applied as coating on the walls of the treatment room 20, rotary cup 12, and drainage cup 14 and a resist is less attached, compared with a conventional case, a running interval of a cleaning treatment between the wall cleanings can be increased.

The thinner discharged when a cup cleaning is carried out is stored into the DR tank 72 after being discharged through the drainage holes 14 of the drainage cup 14.

When quantities of the thinners A1, A2 in the ER tank 70 and DR tank 72 are decreased, the facts are detected by the level sensors 74. The valve 64*a* is controlled by the control section 68, and at the same time N2 gas is supplied to the fresh tank 71 from the N2 supply source not shown to build up a pressure in the fresh tank 71, an unused thinner A0 in the fresh liquid tank 71 is supplied for supplement to the ER tank 70 and DR tank 72 through the supplemental supply pipe 63*a*.

In such a manner as described above, a cleaning efficiency of a cup cleaning is improved and a reliability of an apparatus for a cleaning treatment is also increased without any difficulty in a cup cleaning.

According to the first embodiment of a LCD substrate treatment system, the thinner A1 which is used for removing the unnecessary resist attached to the peripheral portion of the glass substrate G in the edge removing mechanism 2 is stored in the ER tank 70, the thinner A2 which is used for a cup cleaning is stored in the DR tank 72, the thinners A1, A2 stored in the tanks 70, 72 are re-used for a cup cleaning and thereby thinners which have been conventionally discharged can be effectively used, so that loss in usage of thinner is avoided and a running cost is reduced.

Moreover, in the same treatment system including the coating mechanism 1 and edge removing mechanism 2, since the thinner used in the edge removing mechanism 2 is re-used in a cup cleaning in the coating mechanism 1, the piping system can be simplified with some of pipes being eliminated for the reason of commonly used and the apparatus can be designed to a smaller size.

When the levels of the thinners stored in the ER and DR tanks 70, 72 lowered, it is detected by the level sensor 74 and the control means 68 controls so that the fresh liquid is supplied to the tanks 71, 72 from the fresh tank 71 based on the information from the liquid level sensor 74 and therefore there arises no difficulty in a cup cleaning. As a result, re-use of the used thinner can be also optimized.

Another embodiment of the present invention will be described.

While the first embodiment shown in FIG. 4 is an example of a vessel which is disposed outside the ring like passage 14*a* of the drainage cup 14 and the outer side surface of the rotary cup 12, there are various modified shapes of the vessels can conceived.

For example, it is also conceived that the exhaust path in the ring like passage 14*a* of the drainage cup is disposed under the rotary cup 12.

Figure 11:
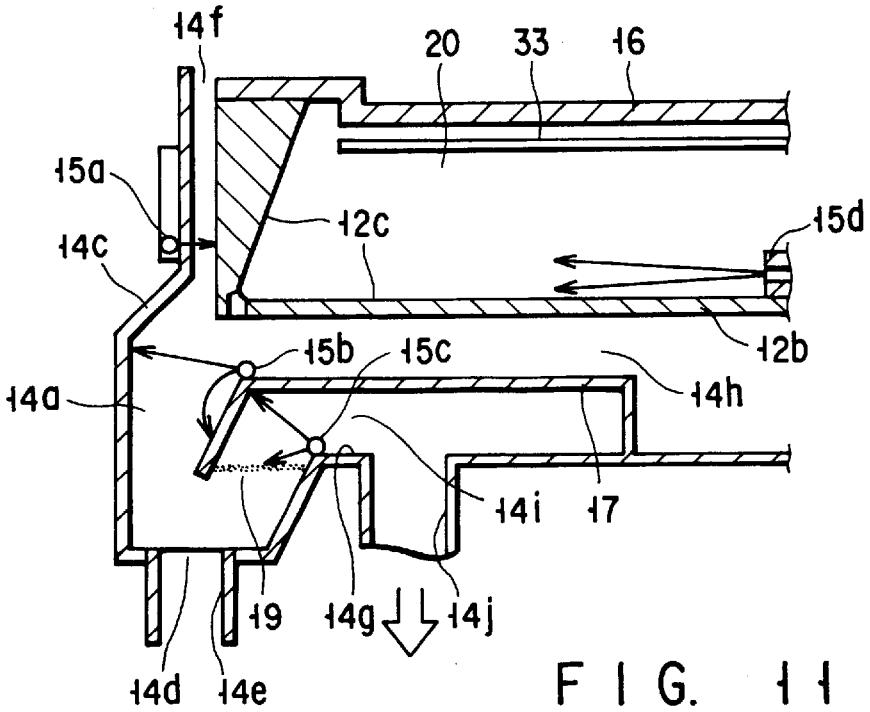
FIG. 11 is a view showing an example of modification of the vessel.

In this case, as shown in FIG. 11, the ring like passage 14*a* is formed in such a manner that a depending wall 14*c* hanging from the ceiling section of the drainage cup 14 is connected to drainage holes 14*e*, an upper clearance 14*f* is created between the wall 14*c* and the outer side surface of the rotary cup 12, an inner ring 17 is formed between a hill portion 14*g* and the bottom 12*b* of the rotary cup 12 to form a clearance 14*h* between the bottom 12*b* of the rotary cup 12 and the inner ring 17, an exhaust gas guide path 14*i* is formed between the inner ring 17 and the hill portion 14*g* of the drainage cup 14, a filter is disposed in an entrance (an opening in an upstream position) of the exhaust guide path 14*i* and air (gas) separated from the thinner is discharged through the filter 19 to the exhaust path 14*j*. In this case, thinner nozzles 15*a*, 15*b*, 15*c* and 15*d* are respectively mounted to the inner ring 17, the hill portion 14*g* and the wall 14*c* and the thinner is jetted to the corresponding wall surfaces as objects to be cleaned. The filter 19 is, for example, a member which is constructed of corrosion resistant wires of stainless steel knitted in the state of a mesh and separates gas and liquid from the discharged material and a mist is exhausted through the exhaust path 14*i* and the thinner is descharged to the drainage holes 14*e*. Such a vessel as this is also has a film coating with a thickness of about 60 μm on the wall surfaces which is touched by the discharged liquid.

Figure 12:
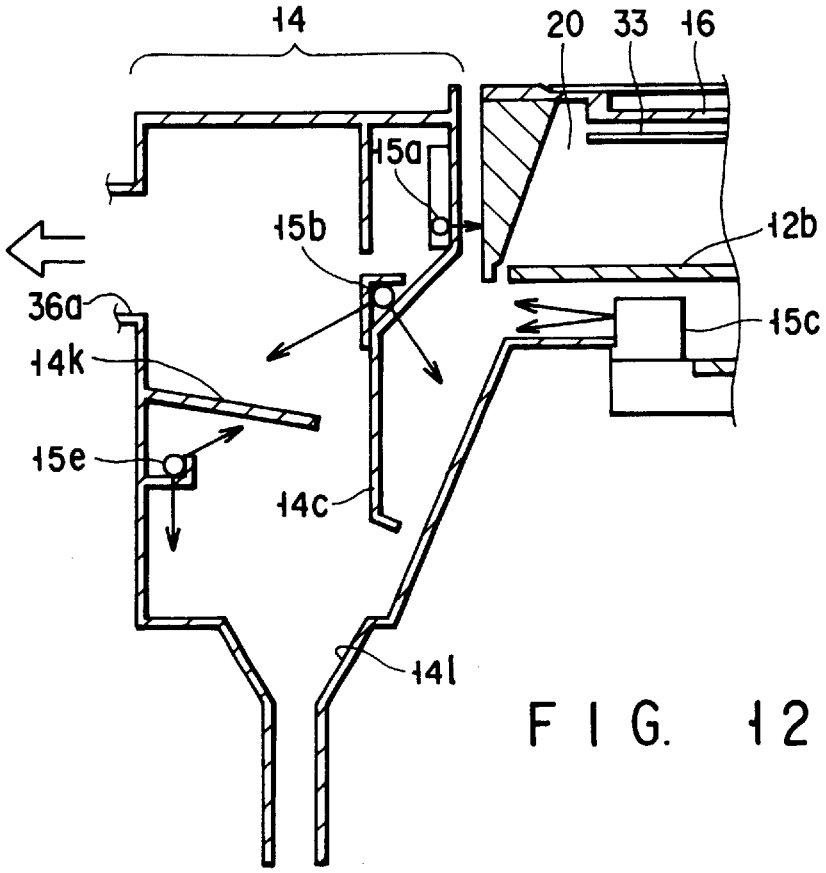
FIG. 12 is a view showing another example of modification of the vessel.

As shown in FIG. 12, an exhaust port 36*a* is formed in the upper portion of the outer wall of the drainage cup 14, a ring like passage 14*a* is formed in such a manner that a wall 14*k* is inwardly protruded from a lower portion of the side wall under the exhaust port 36*a*, a wall 14*c* is vertically depending from a ceiling portion of the drainage cup 14 and the protruding wall 14*k* and the depending wall 14*c* form a detour. On the other hand, a drainage hole 14*i* which has a tapered opening having the maximum diameter at the top is formed so that an efficiency of discharging the discharged liquid can be improved. In this case, in the drainage cup, a plurality of thinner supply nozzles 15*a*, 15*b*, 15*c* and 15*e* are mounted, the thinner is jetted to the corresponding wall surfaces as objects to be cleaned. In such a vessel as constructed according to the above description, too, the wall surfaces to which the discharged liquid is touched are coated with a film of PTFE of a thickness of about 60 μm.

Figure 13:
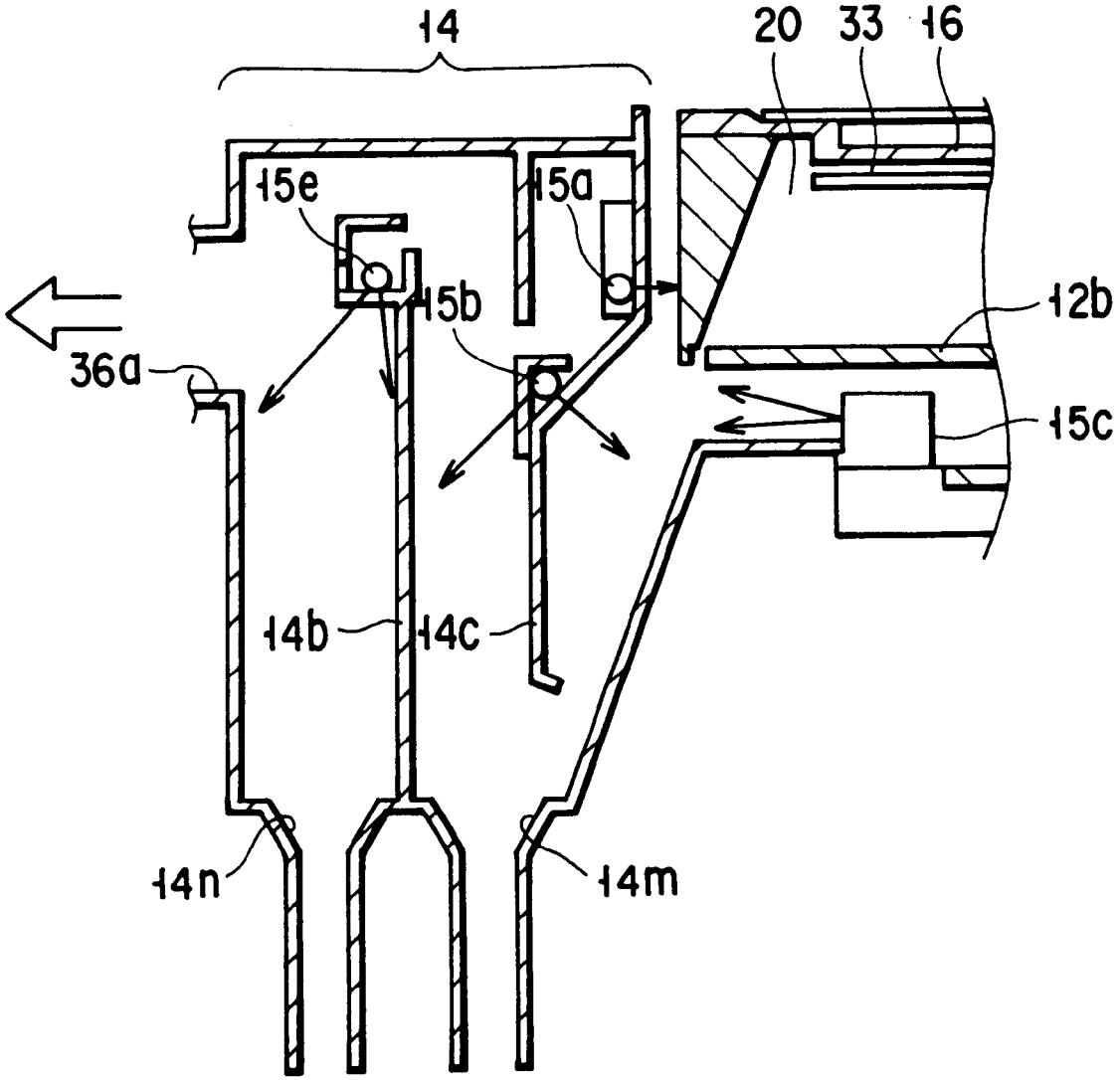
FIG. 13 is a view showing still another example of modification of the vessel.

As shown in FIG. 13, an exhaust port 36*a* is formed in the upper portion of a drainage 14, two exhaust routes are formed by dividing a ring like passage 14*a* in a detouring manner with a wall 14*b* erecting from a bottom 14*d* of the drainage cup 14 and a wall 14*c* depending from a ceiling portion of the drainage cup 14, on the other hand, drainage holes 14*m*, 14*n* with respective tapered openings with the maximum diameters at the tops 14*m*, 14*n* are formed at the two bottoms partitioned by the wall 14*b*, and discharged liquids different in degree of contamination are discharged through different drainage holes so that the discharged liquids can be used in different uses. In this case, a plurality of thinner supply nozzles 15*a*, 15*b*, 15*c* and 15*d* are mounted in the drainage cup 14, the thinner is jetted to respective wall surfaces which are objects to be cleaned. In such a vessel, too, wall surfaces which are touched by discharged liquid are coated by a film of PTFE having a thickness of about 60 μm.

In the above embodiment, while a thinner used for removing unnecessary resist in a peripheral portion of a glass substrate G is again used for cleaning of the insides of treatment rooms 20 of a resist coating/removing apparatuses 107, 108, a rotary cup 12 and a drainage cup 14, it is needless to say that the re-usage of thinner can be applied to cleaning of cups in different shapes. Besides, objects of re-use of cleaning liquid are not necessarily restricted to the cups of the resist coating/removing apparatuses 107, 108, but instead a cup cleaning for any of other apparatuses such as a developing apparatus or a cleaning for an object other than a cup such as a main arm or a mounting table can be included within the scope of the re-use of a cleaning liquid above mentioned.

In the first embodiment above mentioned, while the present invention is applied to A LCD substrate coating/developing system, the present invention can be also applied to a system for a treatment of an object other than a LCD substrate, such as a semiconductor wafer.

Figure 14:
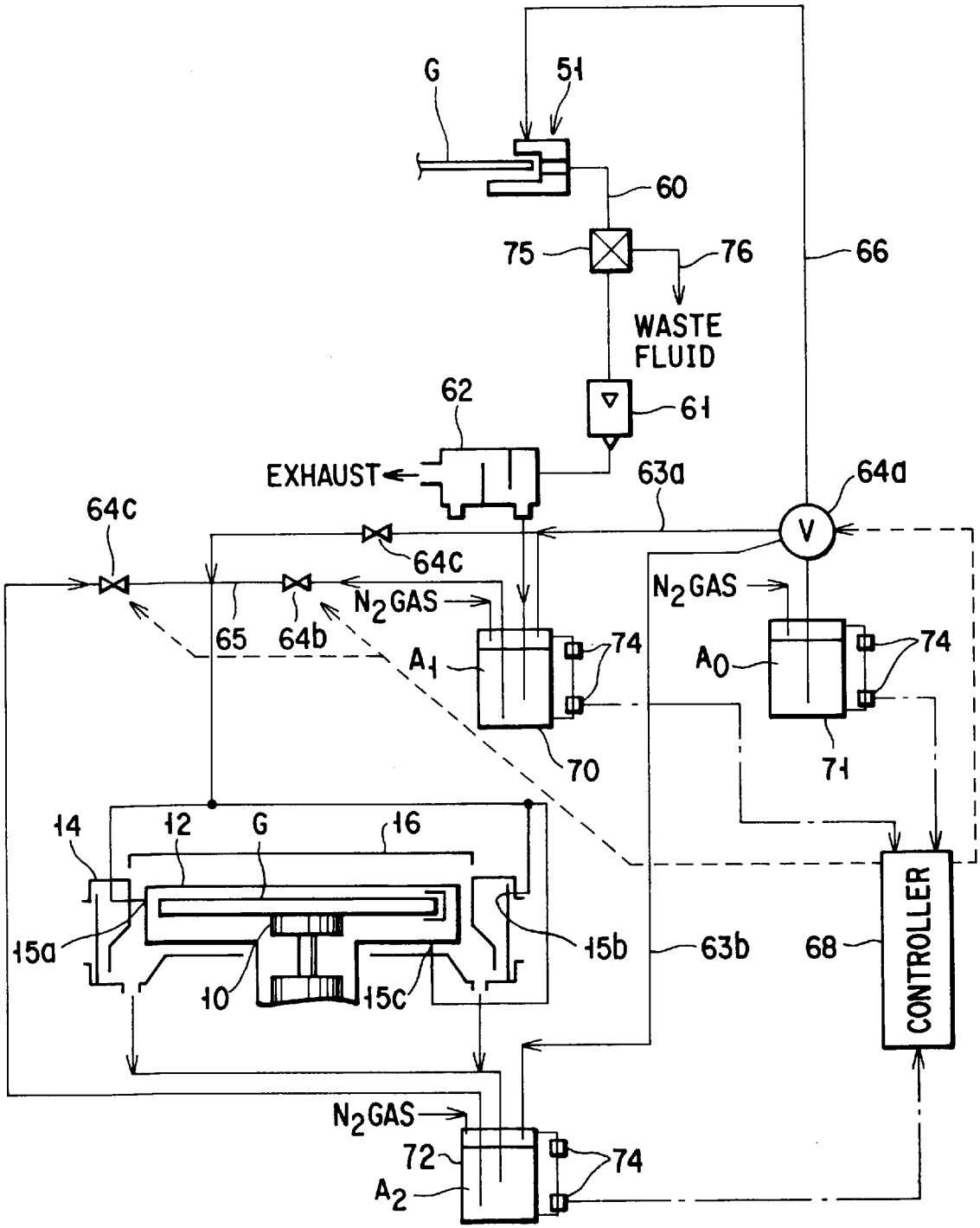
FIG. 14 is a view showing a second apparatus for a cleaning treatment.

The second apparatus for a cleaning treatment according to the present invention will be described in reference to FIG. 14. FIG. 14 is a view showing a construction of an apparatus for coating/developing of a LCD substrate.

A different point from the apparatus for a cleaning treatment of FIG. 10 is in that a thinner re-supply pipe 65 is connected with a fresh tank 71 with valves 64*a*, 64*c* interposed therebetween. When a used thinner A1 is not present in an ER tank 70, or not sufficient, An unused thinner in a fresh liquid tank is used for cleaning a rotary cu 12 and drainage cup 14.

Figure 15:
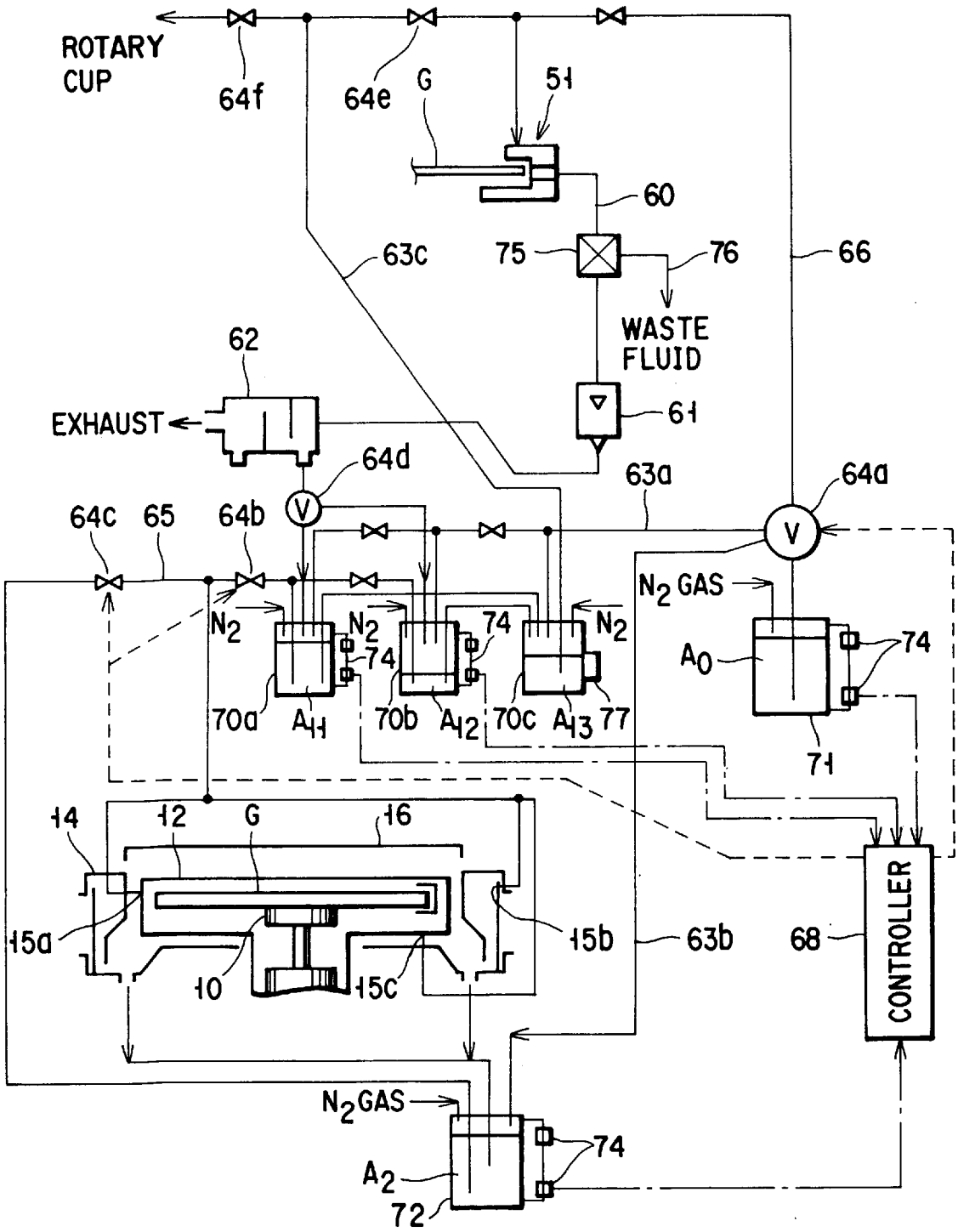
FIG. 15 is a view showing a third apparatus for a cleaning treatment.

The third apparatus for a cleaning treatment according the present invention will be described in reference to FIG. 15.

Different points from the apparatus for a cleaning treatment on the embodiment of FIG. 10 are in that two ER tanks 70*a*, 70*b* are provided and an ER tank 70*c* is further provided for supplying an unused thinner A13 to removing nozzles 51 and a rotary cup 12.

First of all, a used thinner A11 is recovered into the ER tank 70*a* from a mist trap 62 trough a three-way valve 64*d*. If the ER tank 70*a* is filled up, the valve 64*d* is switched and the used thinner A12 is recovered into the ER tank 70*b*. While the used thinner A12 is recovered into the ER tank 70*b*, a rotary cup 12 and drainage cup 14 are cleaned using the thinner A11 in the ER tank 70*a*. If the ER tank 70*b* is filled up, the valve 64*d* is switched and, the used thinner is recovered into the ER tank 70*a* and the thinner A12 in the ER tank 70*b* is used for cleaning. In such a manner, the two ER tanks 70*a*, 70*b* are alternately used and the used thinner can be continuously used.

Moreover, the used thinner A13 which is supplied from the ER tanks 70*a*, 70*b* is stored in the ER tank 70*c*. The used thinner A13 is supplied to removing nozzles 51 through a supply pipe 63*c* and a valve 64*e* and jetted to both surfaces of the outer peripheral portion of a glass substrate G. The used thinner A13 is used for cleaning the inside of the rotary cup 12 through the supply pipe 63*c* and a valve 64*f*. A concentration of a resist in the thinner A13 stored in the ER tank 70*c* is required to be reduced to a concentration equal to or less than a value by dilution in order to remove the unnecessary resist film in a peripheral portion of the glass substrate G or to clean the inside of the rotary cup 12. For this reason, a concentration sensor 77 is provided in the ER tank 70*c* and if a concentration of the thinner is equal to or more than a value, then an unused thinner A0 is supplied to the ER tank 70*c* from the fresh tank 71 for dilution.

Still another embodiment of the present invention will be described referring to an attached drawing. Here, the case where an apparatus for a cleaning treatment according to the present invention is applied to a resist coating apparatus for a LCD substrate.

Figure 16:
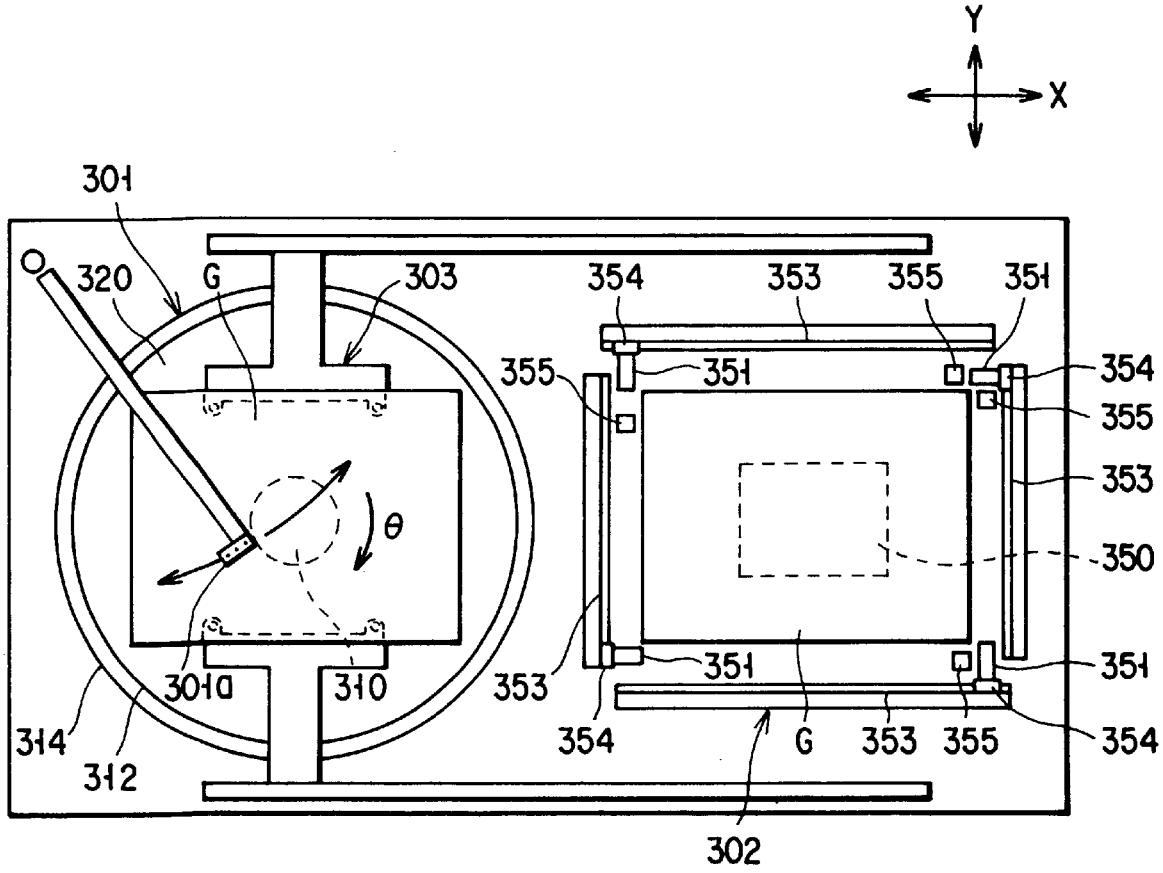
FIG. 16 is a schematic plan view showing a resist coater equipped with a fourth apparatus for a cleaning treatment.

The resist coating apparatus comprises, as shown in FIG. 16: a coating mechanism 301 for applying a coating liquid, for example a resist liquid supplying it to the surface of an object to be treated in an angular shape, for example a LCD substrate G (hereinafter referred to as substrate) in the shape of a rectangle from coating liquid supply nozzles 301*a*, an edge removing mechanism 302 removing an unnecessary resist film formed by coating on a peripheral portion of the substrate G and a transport mechanism 303 transporting the substrate G coated by the coating mechanism 301 to the edge removing mechanism 302.

A main portion of the coating mechanism 301 comprises, as shown in FIG. 16: a spin chuck 310 which is holding means rotating the substrate G in a horizontal plane (θ direction) while vacuum holding the substrate G by a vacuum apparatus not shown, a rotary cup 312 of a cylindrical form with a ceiling and bottom with respective openings therein, which has a treatment room 320 enclosing the upper portion and the outer periphery of the spin chuck 310; a cover 316 which can open or close an opening 312*a* of the rotary cup 312 by being mounted or demounted; a rectifying plate 317 covering the substrate G at a position thereabove, which is held by the spin chuck 310 mounted under the cover 316; and a stationary cup 314 having a shape of a hollow ring disposed outside the rotary cup 312 in surrounding manner. Moreover, the coating apparatus 301 further comprises an apparatus for a cleaning treatment 304 which cleans the bottom surface and the inner side surface of the rotary cup 312, the rear surface of the cover 316, a lower surface of the outer periphery and the inner side surface of the stationary cup.

The spin chuck 310 is freely rotatable (about its axis) in a horizontal plane with the help of a rotary shaft 322 which is rotated by the drive of a drive motor 321 located at lower position, and is shiftable upward or downward by the drive of a vertical shift cylinder 323 connecting with the rotary shaft 322. In this case, the rotary shaft 322 is slidably connected with a spline bearing 327 which is fittingly inserted in a rotary inner cylinder 326*a* which is rotatably mounted on the inner peripheral surface of a stationary collar 324 with a bearing 325*a* interposed therebetween. A driven pulley 328*a* is fixedly mounted on the spline bearing 327, a belt 329*a* is extended between the driven pulley 328*a* and a drive pulley 321*b* fixedly mounted on a drive shaft 321*a* of the drive motor 321. Therefore, the rotary shaft 322 is indirectly rotated by the drive of the motor 321 with the help of the belt 329*a* and then the spin chuck 310 is rotated by rotation of the rotary shaft 322. A cylinder not shown is disposed at a lower portion of the rotary shaft 322, the rotary shaft 322 is connected the vertical shift cylinder 323 with a vacuum seal section 330 lying therebetween in the cylinder and the rotary shaft 322 is movable by the drive of the vertical shift cylinder 323.

The rotary cup 312 is mounted on the top of a connecting cylinder 331 fixed on a rotary outer cylinder 326*b* which is in turn mounted on the outer peripheral surface of the stationary collar 324 with a bearing 325 lying therebetween and a bearing 332 which has a sealing function is disposed between the bottom 312*b* of the rotary cup 312 and the spin chuck 310 so that the bottom 312*b* and the spin chuck 310 are rotatable relative to each other. The rotary cup 312 is rotated by rotation of the driven pulley 328*b* which is fixedly mounted on the rotary outer cylinder 326*b*, and which is rotated by a combination of the actions of the drive pulley 321*b* fixedly mounted on the drive motor 321, the belt 329*b* which is extended between the pulleys 328*b*, 321*b* and the drive motor 321. In this case, a diameter of the driven pulley 328*b* is set same as a diameter of another driven pulley 328*a* fixedly mounted of the rotary shaft 322 and a belt 329*a* and the belt 329*b* are engaged around the same drive motor 321 and thereby the rotary cup 312 and the spin chuck 310 are rotated at the same speed of rotation. Labylinth sealing sections (not shown) are formed in gaps between the opposed faces of the stationary collar 324, the rotary inner cylinder 326*a* and the stationary collar 326*b* and invasion of dust into the rotary cup 312 is prevented while the apparatus is in a rotation treatment. It is also possible that the driven pulleys 328*a*, 328*b* have different diameters to achieve different speeds of rotation.

The rotary cup 312 has a structure that a tapered inner side surface, in which an inner diameter of the rotary cup 312 is decreased upwardly and that an air stream supplied from an air supply hole 334, which is formed in the middle portion of the cover 316 which is sealed with the help of a packing 318 between the cover 316 and a opening 312*a* of the rotary cup 312, flows on and along the rectifying plate 317 disposed under the cover 316 and further along the tapered inner surface and is discharged through an exhaust hole 335 formed at proper position on the lower outer peripheral portion, that is the outer peripheral surface of the lower part of the side wall. With provision of the air supply hole 334 and exhaust hole 335 as mentioned above, when the rotary cup 312 is rotated, an air flowing into the treatment room 320 from the air supply hole 334 is discharged through the exhaust hole 335 and thereby it is prevented that a pressure in the treatment room is reduced to a value less than a necessary negative pressure and the cover 316 can be released from the rotary cup 312 to open it without a required large force when the cover 316 is opened after completion of a cleaning treatment.

Figure 17:
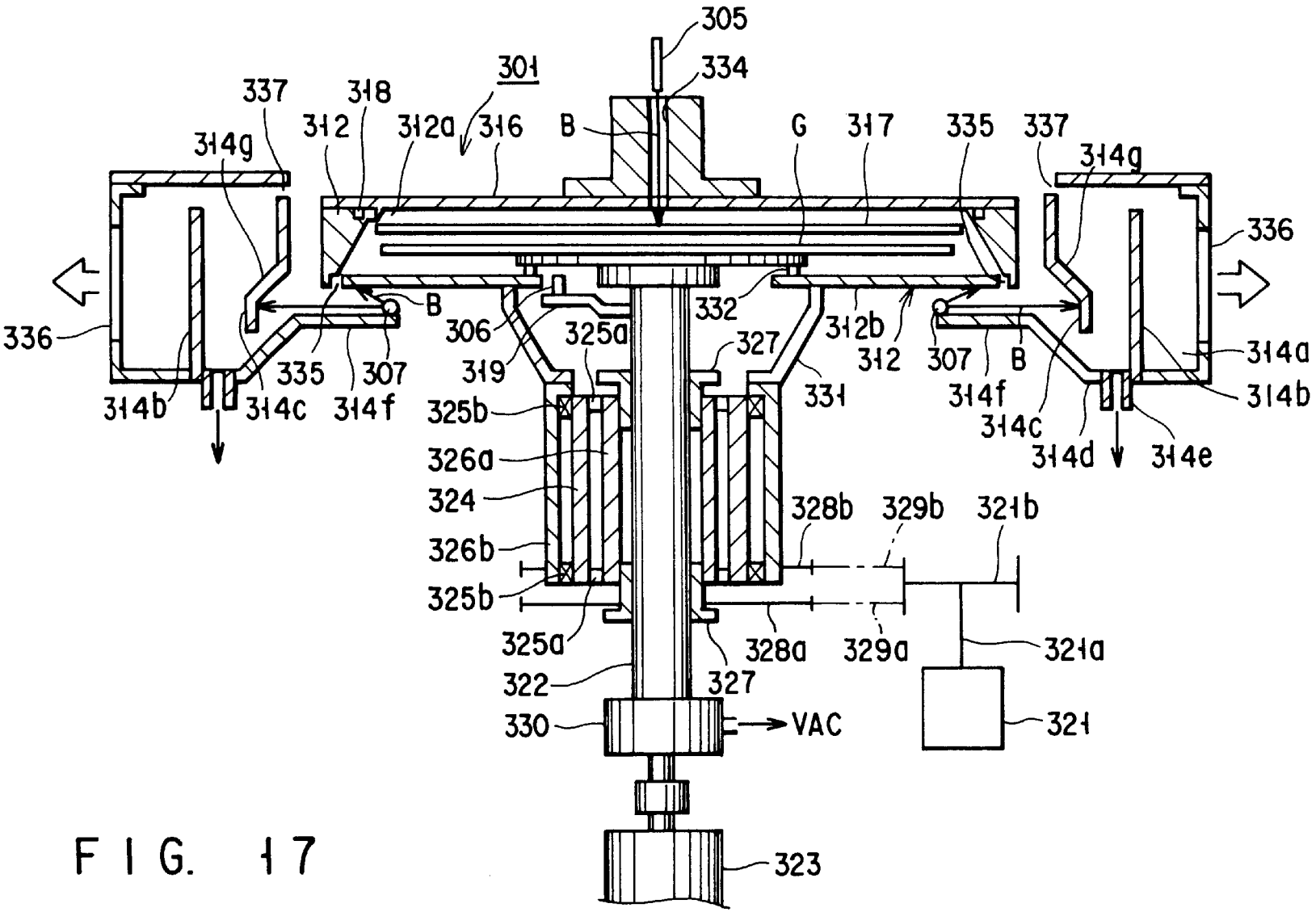
FIG. 17 is a schematic sectional view showing the fourth apparatus of the present invention.
Figure 18:
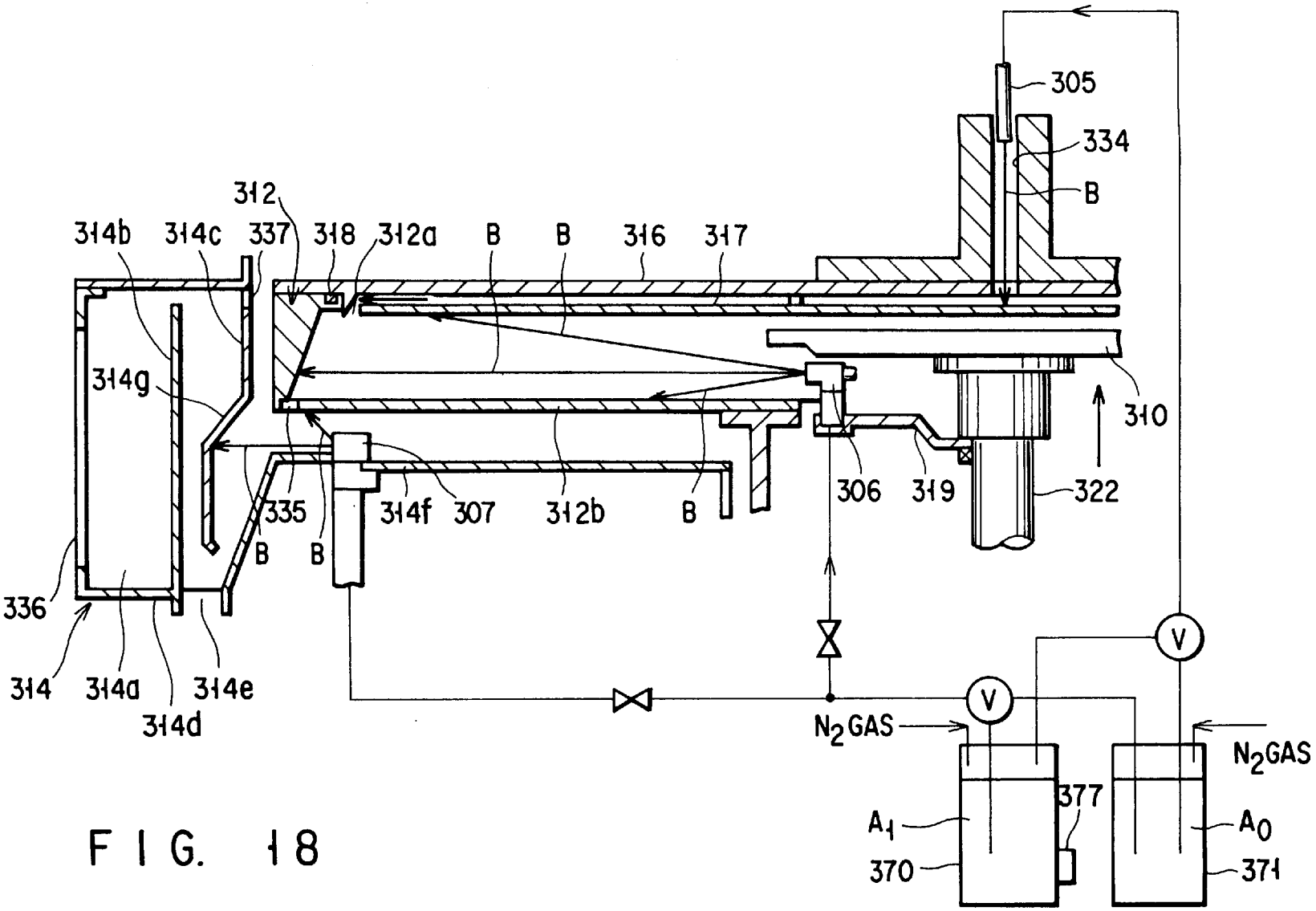
FIG. 18 is an enlarged sectional view showing a main portion of the fourth apparatus.

On the other hand, a ring like passage 314*a* is formed in the stationary cup 314, exhaust holes 336 connected to an exhaust apparatus not shown which holes 336 are formed at proper positions (for example at four positions along a periphery) on the outer peripheral surface and at the same time an exhaust path 337 radially disposed is formed on the upper portion of the inner periphery of the stationary cup 314, the exhaust path 337 being communicated with the exhaust ports 336.9 (see FIGS. 17 and 18). With the exhaust pots 336 on the outer periphery of the stationary cup 314 and the exhaust path 337 on the upper portion of the inner periphery of the stationary cup 314, the exhaust path 337 communicating with the exhaust ports 336, a mist which flows into the stationary cup 314 through the exhaust ports 336 after flying away by a centrifugal force in the treatment room 20 when a rotation treatment is carried out is prevented to flow up to the upper portion in the rotary cup 312 and discharged through the exhaust ports 336.

The ring like path 314*a* is sectionally partitioned by an outer side wall 314*b* of the stationary cup 314 which is erected from a bottom thereof and an inner side wall 314*c* of the stationary cup 314 which is depending from a ceiling thereof in a detouring manner so that exhaust can be uniformly effected, drainage holes 314*e* are formed on a bottom 314*d* between the outer side wall 314*b* and inner side wall 314*c* at a proper distance along the peripheral surfaces of the side walls 314*b*, 314*c*. A bent portion 314*g* which is bent outwardly in the shape of a crank is provided as the lower portion of the inner side wall 314*c*, which is opposed to the lower portion of the rotary cup 312 in such a manner that a open space is formed under the bent portion 314*g*. With such a bent portion 314*g*, a stagnant air space can be created in the stream of air flowing downwardly when a resist coating treatment is conducted and thereby a resist which is sprayed away outwardly is prevented from being carried back upwardly on an air stream.

While there is a need that the cover 316 is rotated in a condition that the cover 316 is fixed to the opening 312*a* of the rotary cup 312 when the rotary cup 312 is rotated, such a condition can be produced when fixed pins (not shown) protruding from the upper surface of the rotary cup 312 and engaging holes (not shown) which are formed on the cover 316 are respectively provided and the fixed pins and engaging holes are fittingly engaged to fix the cover 316 and rotary cup 312 to each other. A robot arm not shown opens or closes the cover.

As shown in FIGS. 17 and 18, the apparatus for a cleaning treatment 304 comprises: a first nozzle 305, which is inserted through a supply holes 334 formed in the middle portion of the cover 316 with a gap, and which jets (supplies) a cleaning liquid, for example a thinner B on the upper surface of the rectifying plate 317, a second nozzle 306 mounted on a bracket 319 fixed on the rotary shaft 322 of the spin chuck 310, which jets (supplies) a cleaning liquid, for example the thinner B on the inner side surface of the rotary cup 312 and the bottom thereof; and a third nozzle 307, which is mounted on a horizontal stripe 314*f* extending inwardly from the bottom 314*d* of the stationary cup 314, and which jets (supply) a cleaning liquid, for example the thinner B, toward a lower surface of the outer peripheral portion of the rotary cup 312, the inner side surface, that is the inner side wall 314*c*, of the stationary cup 314. The first to third cleaning nozzles 305, 306, 307 are connected to thinner tanks 370, 371 and can jet a thinner independently by a gas pressure of N2 gas. The thinner tank 370 is the ER tank described in the above mentioned first to third apparatuses for a cleaning treatment and contains a recovered thinner A1. The thinner tank 371 contains a fresh liquid. The ER tank 370 has a concentration sensor 377 to detect a concentration in the liquid of the ER tank 370. A resist concentration in the ER tank 370 is measured by the concentration sensor 377 and when the concentration exceeds a predetermined value a fresh liquid is supplied from the fresh liquid tank 371 to dilute the existing liquid.

Figure 19:
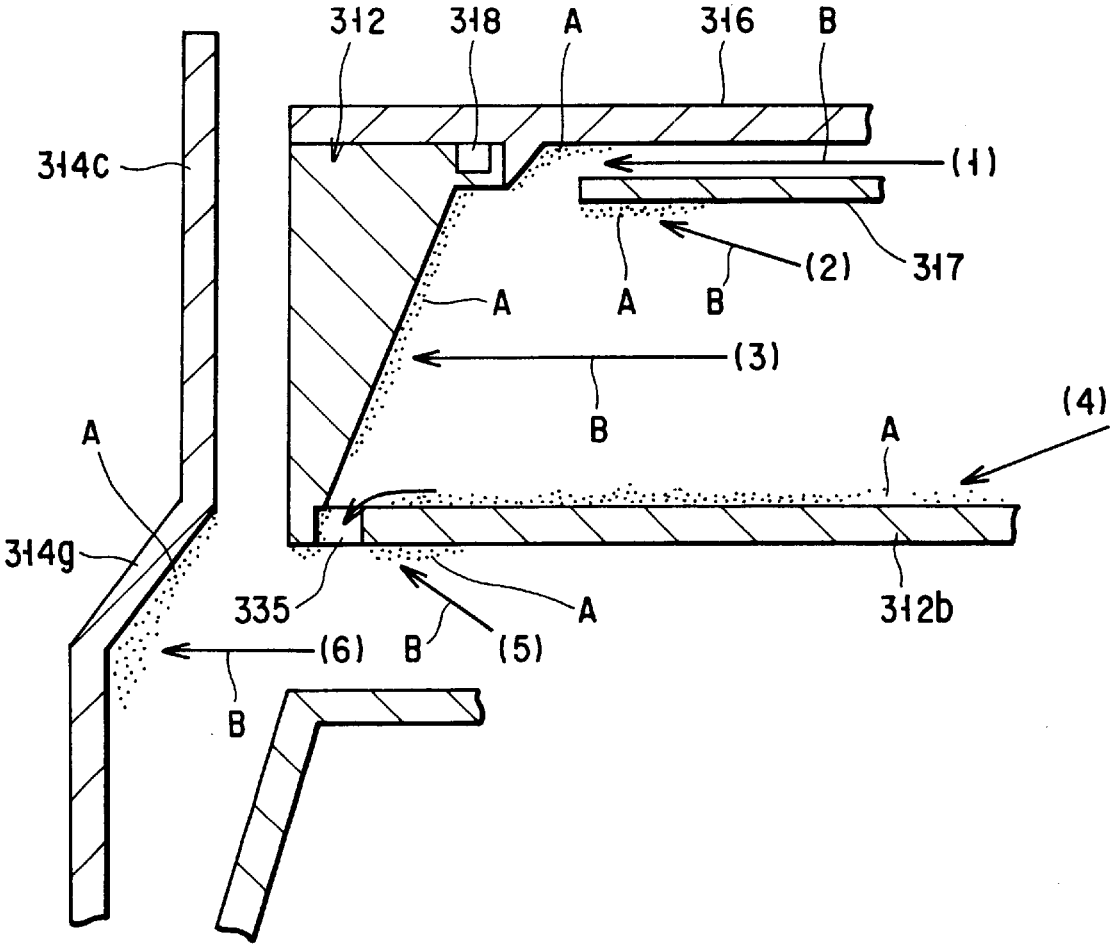
FIG. 19 is a schematic sectional view showing a cleaning section in an operational condition.

With such a construction, the thinner B is jetted from the first cleaning nozzle 305 on the rectifying plate 317 and the thinner B is then sprayed away radially outwardly by a centrifugal force of the rotating rectifying plate 317 to impinge on the lower surface of the cover 316, as shown with (1) of FIG. 19, so that a resist A attached on the lower surface of the cover 16 can be dissolved and removed.

Figure 20A:
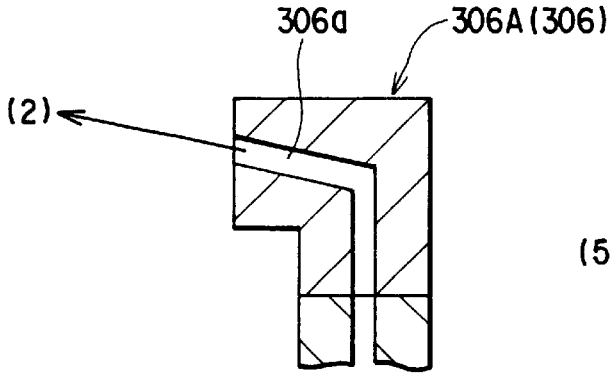
FIGS. 20A, 20B and 20C are schematic sectional views showing different kinds of a second cleaning nozzle.
Figure 20B:
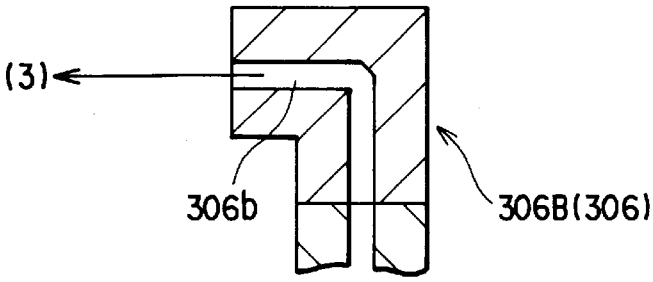
Figure 20C:
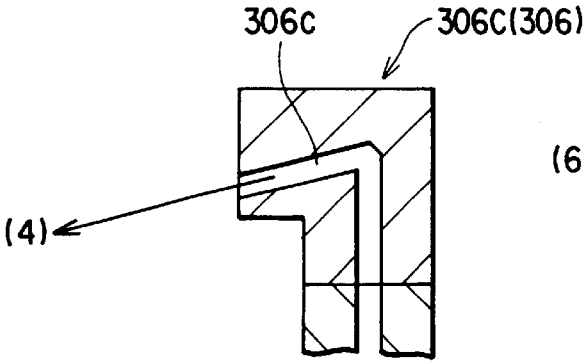

Second cleaning nozzles 306 comprise, as shown in FIGS. 20A, 20B and 20C, the following three kinds of nozzle body: a nozzle body 306A having a nozzle hole 306*a* which jets the thinner B toward a lower surface of the peripheral portion of the rectifying plate 317, a nozzle body 306B having a nozzle hole 306*b* which jets the thinner B toward the inner side surface of the rotary cup 312 and a nozzle body 306C having a nozzle hole 306*c* which jet the thinner B toward the inner portion of the bottom of the rotary cup 312 and the second cleaning nozzles 306 are disposed at a proper angle, that is an equi-angle of 120 degree, along a periphery of the rotary cup 312. The thinner B is jetted from the nozzle holes 306*a*, 306*b*, 306*c* of the respective nozzle bodies 306A, 306B, 306C, toward a lower surface of the outer periphery of the rotating rectifying plate 317 (directions (2) of FIGS. 19 and 20A), toward the inner side surface of the rotary cup 312 directions (3) of FIGS. 19 and 20B) and toward the inner portion of the bottom of the rotary cup 312 (directions (4) of FIGS. 19 and 20C) and can dissolve and remove a resist attached on respective parts of surfaces. The second nozzles 306 are only required to have at least three kinds of nozzle body 306A, 306*b*, 306C and a plurality of sets of the three kinds may be disposed at a proper equi-angular position along a periphery of the rotary cup 312.

Figure 21A:
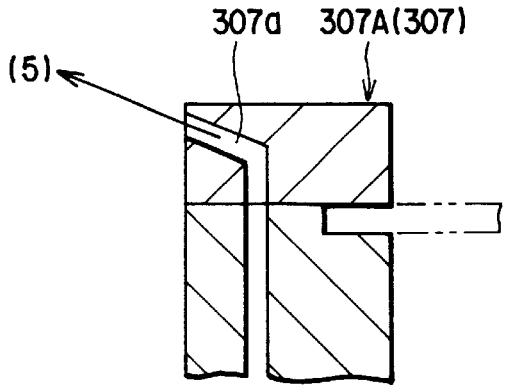
FIGS. 21A and 21B are schematic sectional views showing different kinds of a third cleaning nozzle.
Figure 21B:
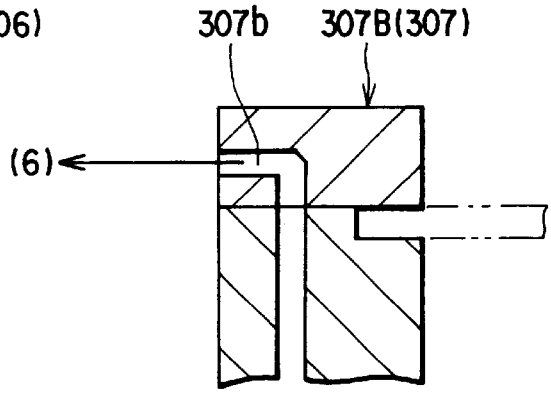

As shown in FIGS. 21A and 21B, third nozzles 307 comprise the following two kinds of nozzle body: a nozzle body 307A having a nozzle hole 307*a*, which jets the thinner B toward a lower surface of the outer peripheral portion of the rotary cup 312; and a nozzle body 307B having a nozzle hole 307*b*, which jets the thinner B toward the inner sidewall 314*c* (in a concrete manner, the bent portion 314*g*) of the stationary cup 314 and the two kinds of nozzle body are disposed along a circular periphery of the rotary cup 312 at a proper angle, for example an equi-angle of 180 degree, about the center. The thinner B is jetted from the nozzle holes 307*a*, 307*b* of the respective nozzle bodies 307A, 307B toward a lower surface of the outer peripheral portion of the rotary cup 312 (direction (5) of FIGS. 19 and 21A) and toward the inner sidewall 314*f* (in a concrete manner, the bent portion 314*g*) of the stationary cup 314 and thereby a resist attached on corresponding locations can be dissolved and removed. It is only required that the third nozzles 307 comprise at least two kinds of nozzle body 307A, 307B and a plurality of sets of the two kinds of nozzle body 207A, 307B may be disposed along a periphery of the rotary cup 312.

A main portion of the edge removing mechanism 302 comprises, as shown in FIG. 16: a mounting able 350 which holds by suction a substrate G by a vacuum apparatus not shown, four removing nozzles 351 as first cleaning supple means, which jets a cleaning liquid, for example a resist thinner, on both surfaces of the edge potion of the four sides of the substrate G held by the mounting table 350.

A removing nozzle 351 is mounted on a sliding member 354 which is free to slide on a guide rail 353 which is provided extending in one of X and Y directions of FIG. 16. The sliding member 354 is constructed with a wire, a chain and a ball screw and a moving mechanism (not shown) using a stepping motor and an air cylinder and the like. A sensor which detects an adjacent position of a removing nozzle 351 is provided so that adjacent removing nozzles 351 do not collide against each other. The sensor detects one of the adjacent removing nozzles 351 approaches to the other and transmits a detecting signal to a control section not shown. The drive of the moving mechanism is stopped by a control signal from the control section and thereby interference or collision between the adjacent removing nozzles 351 is avoided.

Next a cleaning action by the apparatus for a cleaning treatment 304 will be described. A resist coating is conducted on a substrate G by the coating mechanism 301, thereafter the cover 316 is opened, the spin chuck 310 is shifted upward and the substrate G is taken out by a transport arm not shown. Then the cover 316 is closed, the spin chuck 310, the rotary cup 312 and the cover 316 are together rotated (for example, at a speed of rotation in the range of from 350 to 630 rpm) and at the same time the first cleaning nozzle 305 already inserted in the supply hole 334 (for air supply) with a gap jets the thinner B on the central portion of the upper surface of the rotating rectifying plate 317. In such a situation, the thinner B jetted on the upper surface of the rectifying plate 317 is sprayed away outwardly by a centrifugal force to impinge on a lower surface of the outer peripheral potion of the cover 316 and dissolve and remove a resist A attached on the lower surface of the outer peripheral portion of the cover 316 (see FIG. 18 and (1) of FIG. 19).

Then the spin chuck 310 and the rotary cup 312 are rotated at a higher speed of rotation (for example, in the range of 700 to 1300 rpm) and at the same time the thinner B is jetted from the nozzle bodies 306A, 306B of the second cleaning nozzles 306 toward a lower surface of the outer peripheral portion of the rectifying plate 317 and the inner side surface of the rotary cup 312. The thinner impinges on the lower surface of the outer peripheral portion of the rectifying plate 317 and the inner side surface of the rotary cup 312 to dissolve and remove the resist A (see FIG. 18 and (2) and (3) of FIG. 19). At the same time when cleaning of the lower surface of the outer peripheral portion of the rectifying plate 317 and the inner side surface of the rotary cup 312, the thinner B is jetted from the nozzle bodies 307A, 307B of the third cleaning nozzles 307 upward a lower surface of the outer peripheral portion of the rotary cup 312 and the inner side surface, that is sidewall 314*f* (in a concrete manner, the bent portion 314*g*) of the stationary cup 314 to dissolve and remove the resist A attached on the lower surface of the outer peripheral portion of the rotary cup 312 and the inner sidewall 314*f* (in a concrete manner, the bent portion 314*g*) (see FIG. 18 and (5) and (6) of FIG. 19).

The spin chuck 310 and the rotary cup 312 are then rotated at a lower speed of rotation (for example, in the range of 14 to 26 rpm) and at the same time the nozzle body 306C of the second cleaning nozzle 306 jets the thinner B on the bottom surface of the rotary cup 312. The thinner jetted on the bottom surface of the rotary cup 312 is moved on the bottom surface of the rotary cup toward the outer periphery by a centrifugal force to dissolve and remove the resist A attached on the bottom surface (see FIG. 18 and (4) of FIG. 19), and further dissolve and remove the resist A attached in the exhaust hole 335 when it is discharged through the exhaust hole 335.

In the above embodiment, while a cleaning treatment has been described in the case where the cleaning treatment is conducted in the following order: cleaning the lower surface of the outer peripheral portion of the cover 316 ((1) of FIG. 19)→cleaning of the lower surface of the rectifying plate 317, the inner side surface of the rotary cup 312, the lower surface of the outer portion of the rotary cup 312 and the inner sidewall 314*f* (in a concrete manner, the bent portion 314*g*)(see (2), (3), (5), (6) of FIG. 19) 143 cleaning the bottom surface of the rotary cup 312 and the exhaust hole 335 (see (4) of FIG. 19), the order of the steps of cleaning is not limited to the above order, but orders can be arbitrarily selected. Besides, timing of the steps of cleaning is also arbitrarily selected; for example, after each time when a resist coating on a predetermined number of substrates such as one lot of substrates is finished, a cleaning treatment can be regularly conducted.

In the above embodiments, while descriptions is limited to the cases where an apparatus and method for a cleaning treatment of the present invention is applied to a coating apparatus for a LCD substrate, the apparatus and method can be applied to a different apparatus other than the coating apparatus, for example a developing apparatus in a similar manner and to a cup cleaning in a coating apparatus, a developing apparatus and the like for an object other than a LCD substrate, for example a semiconductor wafer.

Additional advantages and modifications will readily occur to those skilled in the art. Therefore, the invention in its broader aspects is not limited to the specific details and representative embodiments shown and described herein. Accordingly, various modifications may be made without departing from the spirit of scope of the general inventive concept as defined by the appended claims and their equivalents.

What is claimed is:

1. An apparatus for a cleaning treatment, comprising:

first supply means for supplying a cleaning liquid to a peripheral portion of a liquid crystal device substrate in order to remove a coating film from the peripheral portion of the substrate;

a recovering pipe for recovering a used cleaning liquid from the substrate;

gas/liquid separation means for separating and removing gas from the recovered liquid through the recovering pipe;

a cleaning liquid storing section for storing the cleaning liquid separated by the gas/liquid separation means;

a coating mechanism including means for supplying a coating liquid to the substrate, means for rotating the substrate, and a drainage cup surrounding a periphery of a rotating substrate and receiving a coating liquid scattering from the substrate; and second cleaning liquid supply means for supplying the cleaning liquid from the cleaning liquid storing section to the drainage cup and removing a foreign substance from the drainage cup.

2. An apparatus for a cleaning treatment according to claim 1, wherein the second cleaning liquid supply means comprises a plurality of cleaning nozzles used to supply a cleaning liquid to each section of the drainage cup on the coating mechanism.

3. An apparatus for a cleaning treatment according to claim 1, wherein the first supply means includes:

a plurality of nozzle holes for jetting the cleaning liquid toward positions, which do not interfere with each other, on both surfaces of the peripheral portion of the substrate; and a suction opening surrounding the plurality of nozzle holes and communicating with the cleaning liquid storing section.

4. An apparatus for a cleaning treatment according to claim 1, further comprising the cleaning liquid supply source supplying a new cleaning liquid to the cleaning liquid storing section.

* * * * *